US011680461B2

(12) United States Patent
Partridge

(10) Patent No.: US 11,680,461 B2
(45) Date of Patent: Jun. 20, 2023

(54) SLIDING SLEEVE VALVE AND SYSTEMS INCORPORATING SUCH VALVES

(71) Applicant: FMC Technologies, Inc., Houston, TX (US)

(72) Inventor: Jeffrey Partridge, Spring, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 17/835,423

(22) Filed: Jun. 8, 2022

(65) Prior Publication Data

US 2022/0298888 A1 Sep. 22, 2022

Related U.S. Application Data

(63) Continuation of application No. 16/677,334, filed on Nov. 7, 2019, now Pat. No. 11,473,403.

(51) Int. Cl.
*E21B 34/10* (2006.01)
*E21B 17/10* (2006.01)

(52) U.S. Cl.
CPC ..... *E21B 34/10* (2013.01); *E21B 17/1085* (2013.01); *E21B 2200/06* (2020.05)

(58) Field of Classification Search
CPC ..... E21B 2200/06; E21B 34/10; E21B 34/14; E21B 17/1085
See application file for complete search history.

(56) References Cited

U.S. PATENT DOCUMENTS 3,376,935 A 4/1968 Baker
2006/0237194 A1* 10/2006 Donald ..... E21B 43/162 166/305.1
2015/0107821 A1* 4/2015 Guidry ..... E21B 34/02 166/86.2
2018/0231135 A1* 8/2018 Matteucci ..... F16K 11/0712
2020/0024936 A1* 1/2020 Chang ..... E21B 43/114

OTHER PUBLICATIONS

Office Action issued in Canadian Application No. 3,098,044, dated Oct. 21, 2022 (8 pages).

* cited by examiner

*Primary Examiner* — Dany E Akakpo
(74) *Attorney, Agent, or Firm* — Osha Bergman Watanabe & Burton LLP

(57) ABSTRACT

One illustrative valve disclosed herein includes a body, a first flow bore in the body that includes a fluid flow gallery, a first fluid flow port and a second fluid flow port, wherein the fluid flow gallery is in fluid communication with the first and second fluid flow ports. In this example, the valve also includes a second flow bore in the body and at least one sliding sleeve positioned in the body, wherein the at least one sliding sleeve is adapted to be moved from a first closed position to a second open position, and vice-versa, wherein, in the first closed position, fluid communication between the first flow bore and the second flow bore is blocked and wherein, in the second open position, fluid communication between the first flow bore and the second flow bore is established.

11 Claims, 19 Drawing Sheets

Fig. 5
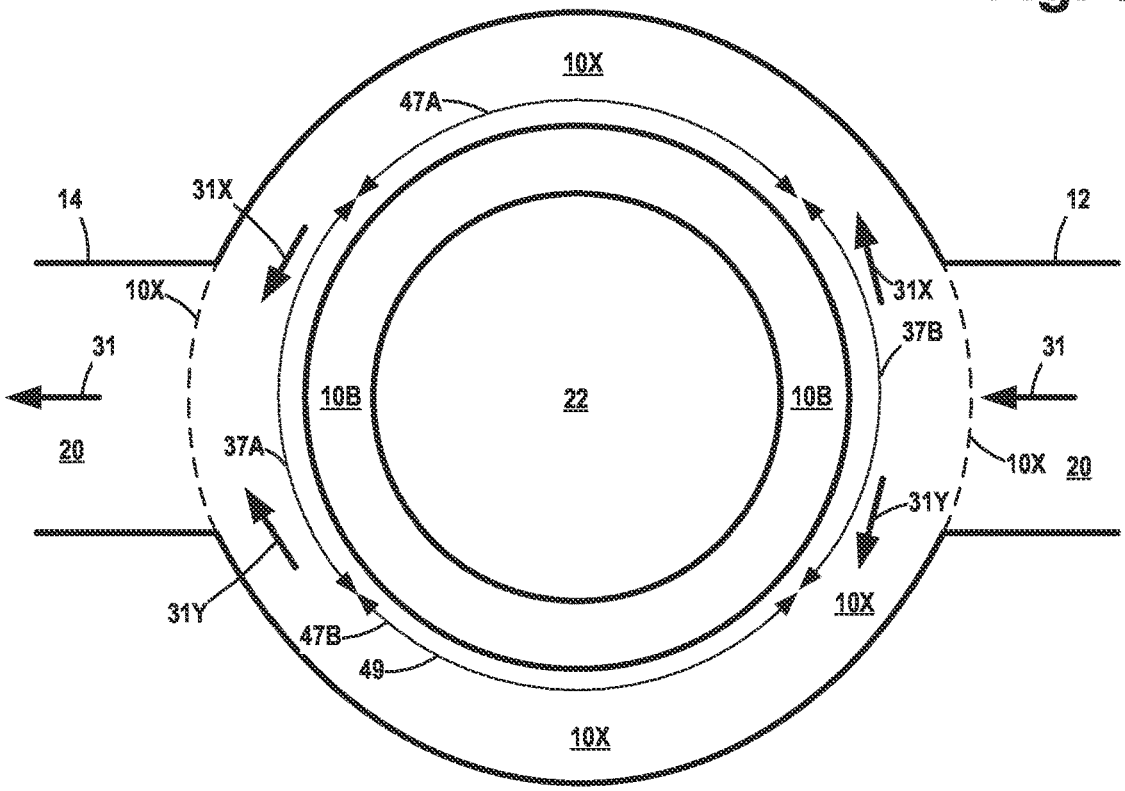
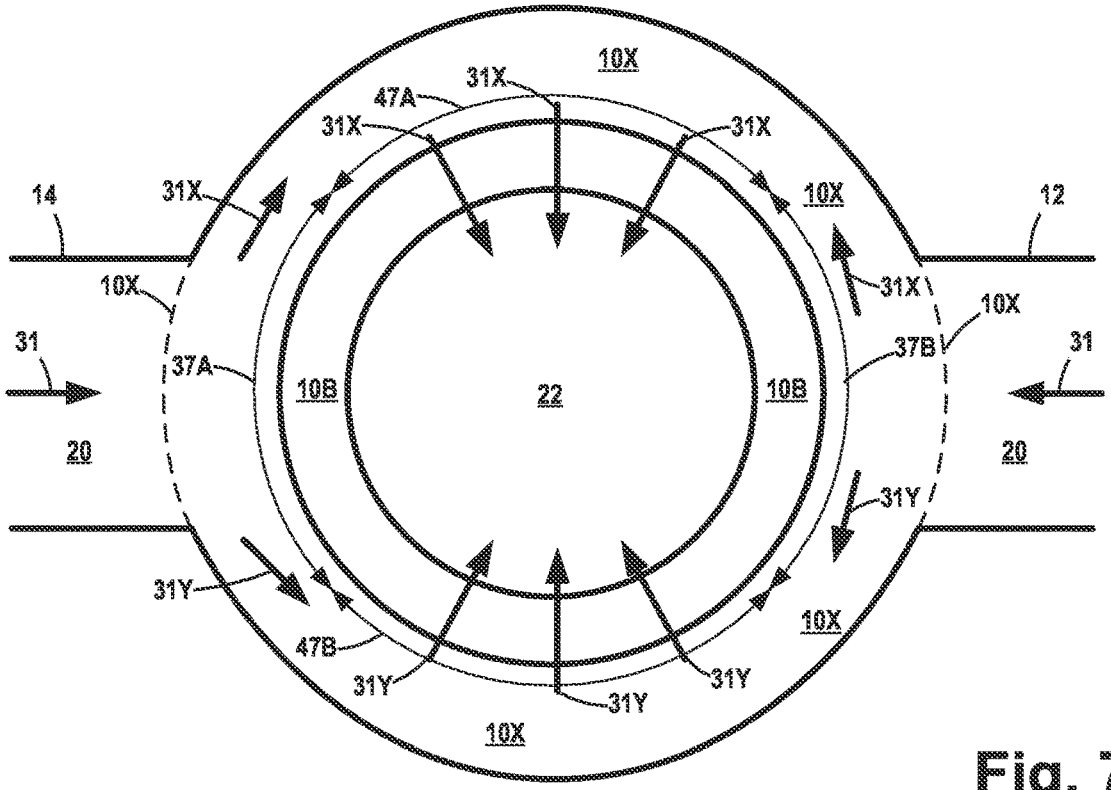
Fig. 7

SLIDING SLEEVE VALVE AND SYSTEMS INCORPORATING SUCH VALVES

BACKGROUND

1. Field of the Disclosure

The present disclosure is generally directed to various novel embodiments of sliding sleeve valves and various systems and applications where such valves may be employed.

2. Description of the Related Art

Recent years have seen many wells drilled and produced using well-known fracking techniques. Fracturing techniques typically involve forming a plurality of perforations through a cemented casing positioned in a wellbore. The initial perforations extend into the formation for at least some distance. At that point, a relatively large quantity of a high-pressure fracturing ("frac") fluid (typically a combination of water, chemical additives and proppants (e.g., sand, ceramics, etc.)) is pumped into the wellbore. The high pressure of the frac fluid and the continual pumping of the frac fluid increases the pressure within the well until such time as the pressure within the well is sufficient (e.g., 10,000 psi or greater) to overcome the fracture strength of the surrounding formation thereby forming cracks that extend outward from the well and into the formation. The pumping of the high-pressure frac fluid is continued so as to cause the initial cracks in the formation to extend a desired distance into the formation. Once the final cracks or final fractures of the desired length are formed in the formation, the pumping will be stopped and the pressure within the well and the cracks is greatly reduced. However, the proppants that were pumped into the factures under high pressure will prevent the fractures from completely closing once the pumping of frac fluid at high pressure is stopped, i.e., the proppants will act to hold the final fractures open. At that point, the frac fluid is removed from the wellbore and hydrocarbon-containing fluids, e.g., oil and gas, are allowed to flow from the formation and into the wellbore through the propped-open fractures.

Some existing fracturing systems include, among other things, numerous valves, an extensive network of pipes, a number of trucks that contain high-pressure pumping equipment, a blender, and a frac manifold. The high-pressure pumping equipment is operatively coupled to the frac manifold so as to increase the pressure of the frac fluid as it is pumped into the well and ultimately out into the cracks formed in the formation. A function of a typical frac manifold is to receive pressurized fluid from the pumping equipment and to divide the pressurized fluid into manifold legs, with each leg being devoted to one wellbore and containing two gate valves to isolate that wellbore from the flow of pressurized frac fluid. In a modern frac environment, in which there may be four or more wells connected to a single frac manifold, a plurality of gate valves are typically used for purposes of directing the high-pressure frac fluid to a particular well while isolating other wells from the high-pressure frac fluid. Unfortunately, such gate valves contribute considerably to the overall weight and size of the manifold as well as the overall cost of a particular fracturing job. Moreover, there are limitations with respect to how the gate valves can be arranged to isolate one or more of the wellbores.

The present disclosure is therefore directed to various novel embodiments of sliding sleeve valves and various systems and applications where such valves may be employed.

SUMMARY OF THE DISCLOSURE

The following presents a simplified summary of the present disclosure in order to provide a basic understanding of some aspects disclosed herein. This summary is not an exhaustive overview of the disclosure, nor is it intended to identify key or critical elements of the subject matter disclosed here. Its sole purpose is to present some concepts in a simplified form as a prelude to the more detailed description that is discussed later.

The present disclosure is generally directed to various embodiments of sliding sleeve valves and various systems and applications where such valves may be employed. One illustrative valve disclosed herein includes a body, a first flow bore in the body that comprises a fluid flow gallery, a first fluid flow port and a second fluid flow port, wherein the fluid flow gallery is in fluid communication with the first and second fluid flow ports. In this example, the valve also includes a second flow bore in the body and at least one sliding sleeve positioned in the body, wherein the at least one sliding sleeve is adapted to be moved from a first closed position to a second open position, and vice-versa, wherein, in the first closed position, fluid communication between the first flow bore and the second flow bore is blocked and wherein, in the second open position, fluid communication between the first flow bore and the second flow bore is established.

One illustrative production tree disclosed herein includes a flow cross block, a first flow bore in the flow cross block, wherein the first flow bore comprises a fluid flow gallery, a first fluid flow port and a second fluid flow port, wherein the fluid flow gallery is in fluid communication with the first and second fluid flow ports. In this example, the production tree also includes a second flow bore in the flow cross block and at least one sliding sleeve positioned in the flow cross block, wherein the at least one sliding sleeve is adapted to be moved from a first closed position to a second open position, and vice-versa, wherein, in the first closed position, fluid communication between the first flow bore and the second flow bore is blocked and wherein, in the second open position, fluid communication between the first flow bore and the second flow bore is established.

One illustrative system disclosed herein includes a plurality of production trees, each of which is positioned above a well. Each of the production trees comprises a flow cross block, a first flow bore in the flow cross block, wherein the first flow bore comprises a fluid flow gallery, a first fluid flow port and a second fluid flow port, wherein the fluid flow gallery is in fluid communication with the first and second fluid flow ports. In this example, the production tree also includes a second flow bore in the flow cross block and at least one sliding sleeve positioned in the flow cross block, wherein the at least one sliding sleeve is adapted to be moved from a first closed position to a second open position, and vice-versa, wherein, in the first closed position, fluid communication between the first flow bore and the second flow bore is blocked and wherein, in the second open position, fluid communication between the first flow bore and the second flow bore is established. In this example, the system further includes a fluid flow conduit system operatively coupled to the first flow bore in each of the plurality of production trees.

BRIEF DESCRIPTION OF THE DRAWINGS

The disclosure may be understood by reference to the following description taken in conjunction with the accompanying drawings, in which like reference numerals identify like elements, and in which:

FIGS. 1-21 are various views of various embodiments of the sliding sleeve valves disclosed herein and various illustrative systems and applications where such sliding sleeve valves may be employed.

Figure 1:
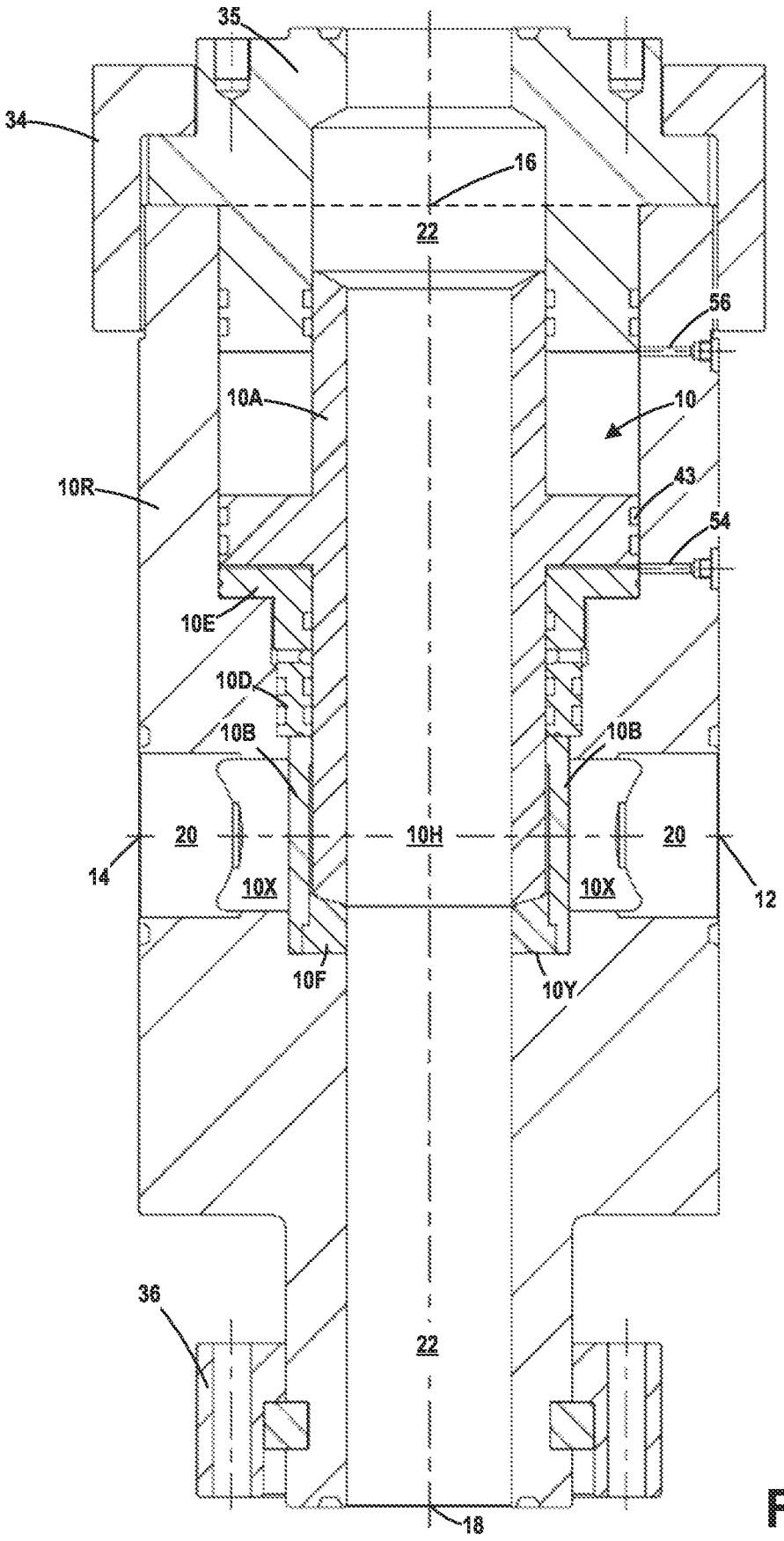

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments of the invention may be practiced without some or all of such various disclosed details. Furthermore, features and/or processes that are well known in the art may not be described in full detail so as not to unnecessarily obscure the disclosure of the present subject matter. In addition, like or identical reference numerals may be used to identify common or similar elements.

FIGS. 1-21 are various views of various embodiments of the sliding sleeve valves 10 disclosed herein and various illustrative systems and applications where such sliding sleeve valves 10 may be employed. As one example, the illustrative sliding sleeve valves 10 disclosed herein may be used in place of a typical gate valve to isolate a wellbore from a source of pressurized fluid, for example, a pressured frac fluid. Furthermore, the illustrative sliding sleeve valves 10 disclosed herein may perform the isolation function of a typical gate valve even though the sliding sleeve valves 10 disclosed herein may typically be smaller in size and weight as compared to a typical gate valve. Additionally, illustrative embodiments of the sliding sleeve valves 10 disclosed herein may provide operational functionality not available in typical gate valves, as will be described below, thereby allowing the sliding sleeve valves 10 disclosed herein to be configured and arranged in novel ways that significantly simplify operations performed in at least some systems and applications, such as, for example, fracturing operations. However, as will be appreciated by those skilled in the art after a complete reading of the present application, the novel sliding sleeve valves 10 disclosed herein are not limited to any particular use or application, i.e., the sliding sleeve valves 10 described herein are not limited to use only in fracturing operations and systems nor are they limited to systems where they may be employed to replace gate valves.

Figure 2:
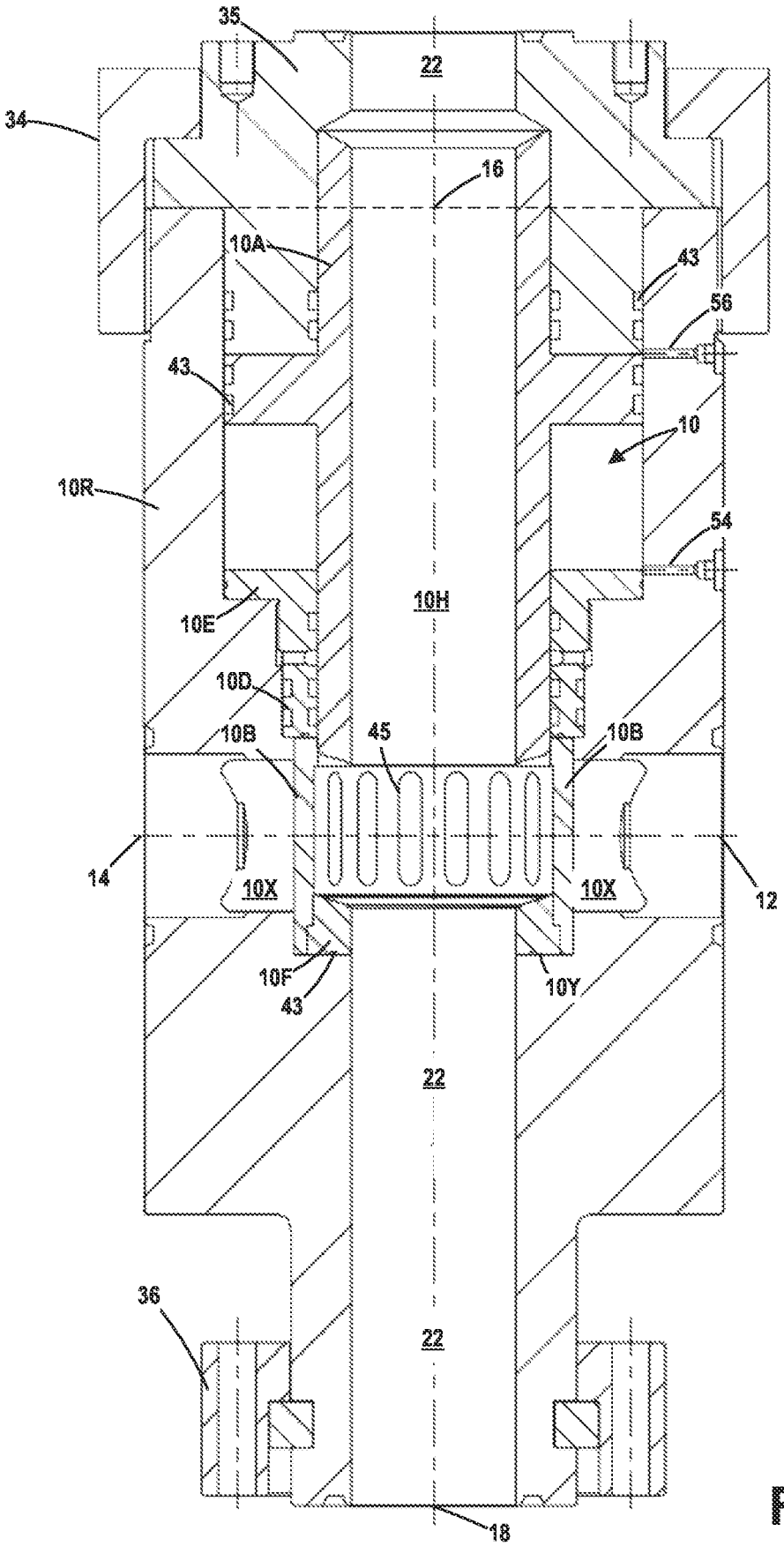
Figure 3:
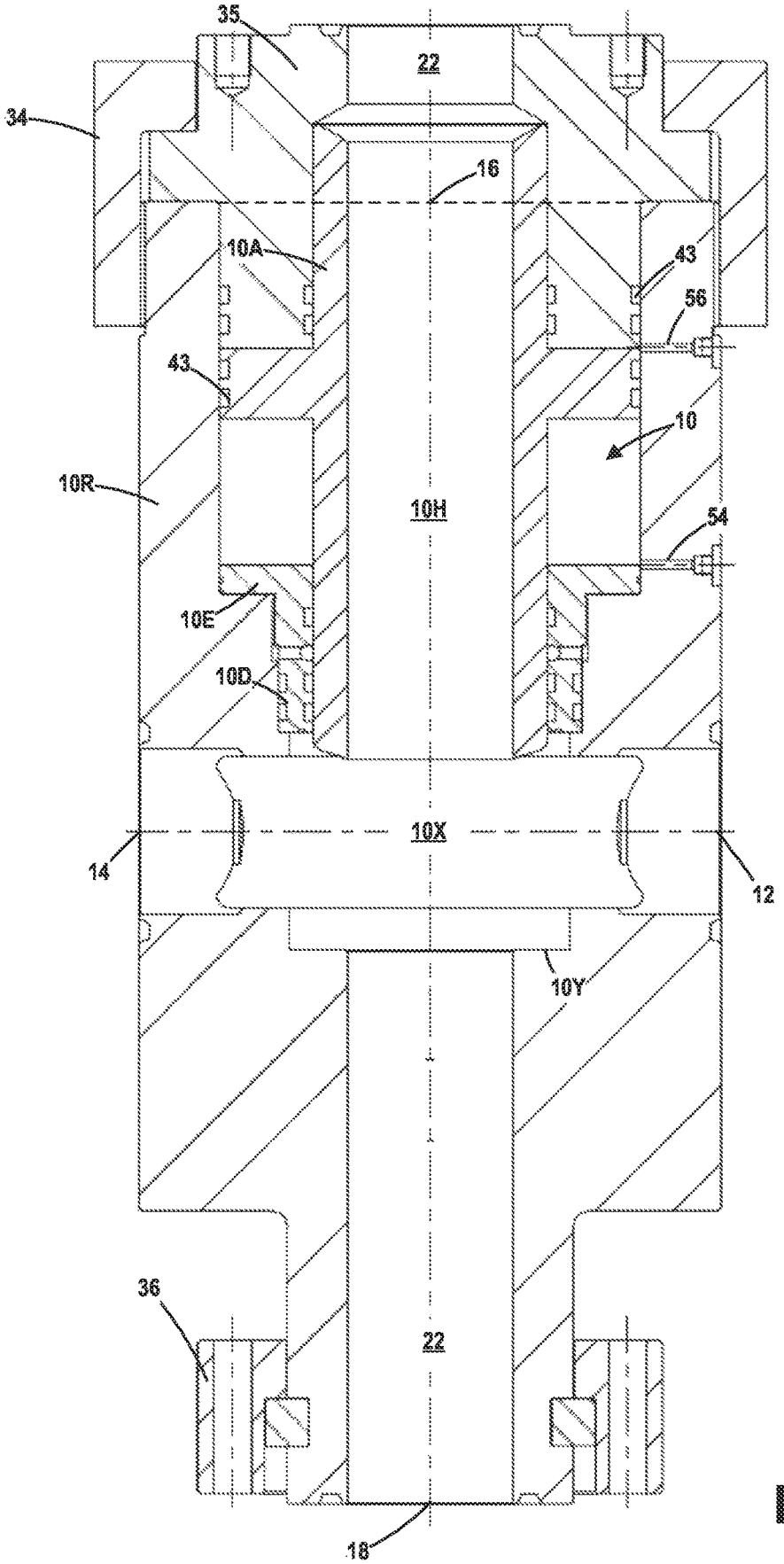

FIG. 1 is an enlarged cross-sectional view of one illustrative embodiment of a novel sliding sleeve valve 10 disclosed herein with the sliding sleeve valve 10 in its closed position. FIG. 2 is an enlarged cross-sectional view of the sliding sleeve valve 10 shown in FIG. 1 with the sliding sleeve valve 10 in its open position. FIG. 3 is an enlarged cross-sectional view of the sliding sleeve valve 10 shown in FIG. 2 in the open position with the wear sleeve 10B (discussed below) and the wear sleeve seat 10F. (discussed below) of the sliding sleeve valve 10 removed.

As shown in the above-referenced drawings, the sliding sleeve valve 10 comprises a valve body 10R and a sliding sleeve 10A that is at least partially positioned within the valve body 10R. In the depicted example, the sliding sleeve 10A comprises a tubular structure with an internal bore 10H. It should be appreciated that the sliding sleeve 10A is not limited to this particular shape and configuration. As described more fully below, the sliding sleeve 10A may be shifted within the valve body 10R to a first position where the sliding sleeve valve 10 is closed (see FIG. 1) or to a second position where the sliding sleeve valve 10 is open (see FIG. 2), and vice-versa.

The sliding sleeve valve 10 also comprises fluid flow ports 12, 14, 16 and 18 formed in the valve body 10R. In the depicted example, the valve 10 comprises a first flow bore (or path) 20 and a second flow bore (or path) 22 that intersect one another. In the depicted example, the first flow bore 20 comprises the fluid flow port 12, the fluid flow port 14 and a fluid flow gallery 10X (discussed more fully below) formed in the body 10R of the valve 10. The fluid flow gallery 10X is in fluid communication with the fluid flow ports 12 and 14. The second flow bore 22 comprises the fluid flow port 16, the fluid flow port 18 and the internal bore 10H of the sliding sleeve 10A. In the depicted example, the internal bore 1011 of the sliding sleeve 10A is substantially coaxial with the second flow bore 22. Moreover, in one illustrative example, when viewed from above, the fluid flow gallery 10X may have a substantially annular configuration that surrounds the second flow bore 22 and the internal bore 10H of the sliding sleeve 10A. It should be understood that the use of the term "bore" in reference to the first flow bore 20, the second flow bore 22 and the internal bore 10H of the sliding sleeve 10A does not imply any particular physical configuration for the first flow bore 20, the second flow bore 22 and the internal bore 10H.

As will be appreciated by those skilled in the art after a complete reading of the present application, when the sliding sleeve valve 10 is closed (see FIG. 1), the first flow bore 20 is isolated from the second flow bore 22. However, when the sliding sleeve valve 10 is open (see FIG. 2) there is fluid communication between the first flow bore 20 and the second flow bore 22. Additionally, when the sliding sleeve valve 10 is closed (and the fluid flow ports 12, 14 are not blocked), fluid may flow through the valve 10 via the first flow bore 20. One advantage of the valve 10 disclosed herein is that there are potentially two completely isolated flow pathways through the valve 10—the first flow bore 20 and the second flow bore 22—that may be utilized when the sliding sleeve 10A is closed. A first flow pathway may comprise the first flow bore 20 and the flow gallery 10X, which may collectively allow fluid to flow through the valve body 10 even when the sliding sleeve 10A is in its closed position. In this manner, any of the four fluid flow ports 12, 14, 16 and 18 of the valve 10 may function as a fluid inlet or a fluid outlet.

In the depicted example, the first flow bore 20 is oriented substantially horizontally, while the second flow bore 22 is oriented substantially vertically, i.e., they are oriented substantially orthogonally with respect to one another. However, as will be understood by those skilled in the art after a complete reading of the present application, the first flow bore 20 and the second flow bore 22 may be oriented in any direction relative to one another or relative to a common reference surface. For example, the valve 10 shown in FIG. 1 could be rotated ninety degrees clockwise such that the first flow bore 20 is oriented substantially vertically and the second flow bore 22 is oriented substantially horizontally. Additionally, in some applications, the first flow bore 20 and the second flow bore 22 may be formed such that there is a non-orthogonal relationship between the first and second flow bores 20, 22.

As will be appreciated by those skilled in the art after a complete reading of the present application, the sliding sleeve valve 10 disclosed herein may be employed in a variety of different applications and various fluid flow paths may be established through the sliding sleeve valve 10 depending upon the particular application. That is, as noted above, depending upon the particular application, each of the fluid flow ports 12, 14, 16 and 18 may function as either a fluid inlet or a fluid outlet. In other applications, one or more of the fluid flow ports 12, 14, 16 and 18 may be blinded (or blocked) on a temporary or permanent basis so as to achieve the desired fluid flow path(s) through the valve 10 when the valve 10 is open or closed. For example, a blind flange (or like structure) may be operatively coupled to the fluid flow port 16 or another valve (not shown, e.g., a gate valve) may be positioned upstream of the fluid flow port 12 to block fluid flow to the fluid flow port 12 on an as needed basis. Various fluid flow conduits (not shown), e.g., piping, may be operatively coupled to one or more of the fluid flow ports 12, 14, 16 and 18 using known techniques. For example, an illustrative flange 36 is coupled to the valve body 10R adjacent to the fluid flow port 18 and it may be coupled to a flanged fluid piping (not shown). In the depicted example, an illustrative and representative cap 35 is coupled to the valve body 10R by some form of a connector 34, e.g., a threaded, bolted or clamped connection. As will be appreciated by those skilled in the art, the illustrative cap 35 is representative in nature as the cap may take other forms or be part of other structures. For example, the cap 35 could be part of a spool that is coupled to the valve 10, it could be part of the body 10R, it could represent part of an actuator housing, etc.

One illustrative embodiment of the sliding sleeve valves 10 depicted herein further comprises a perforated wear sleeve 10B, a seal ring 10D, a retainer 10E and a seat 10F. Also shown in the drawings are various simplistically depicted seals 43 that are positioned among and between the various components of the sliding sleeve valve 10. The seat 10F is adapted to be positioned in a recess 10Y formed in the valve body 10R. In the depicted example, the lowermost end of the sliding sleeve 10A is adapted to engage the seat 10F when the sliding sleeve 10A is in its lowermost position. i.e., when the valve 10 is closed (see FIG. 1). The retainer ICE is adapted to be coupled to the body 10R so as to retain the seal ring 10D and the wear sleeve 10B in position within the valve 10. The retainer 10E may be coupled to the body 10R by a variety of known techniques, e.g., a threaded connection, a bolted connection, etc.

In general, with reference to FIG. 2, the perforated wear sleeve 10B comprises at least one opening 45 formed therein. When the sliding sleeve 10A is moved to its uppermost (and open) position, the at least one opening 45 allows fluid communication between the first flow bore 20 and the second flow bore 22. In the depicted example, the illustrative wear sleeve 10B comprises a plurality of openings 45 formed in the wear sleeve 10B. The number, size, placement and shape of the opening(s) 45 may vary depending upon the particular application. In the illustrative example depicted in FIG. 2, the openings 45 may take the form of a plurality of substantially vertically oriented slots. Of course, the openings 45 may have other configurations, e.g., circular openings, oval openings, etc.

In the example disclosed herein, the sliding sleeve 10A takes the form of a piston. With reference to FIG. 1 (wherein the valve 10 is in its closed position), a lower hydraulic fluid inlet/outlet 54 and an upper hydraulic fluid inlet/outlet 56 are provided in the body 10R of the sliding sleeve valve 10. The lower hydraulic fluid inlet/outlet 54 and the upper hydraulic fluid inlet/outlet 56 are operatively coupled to a source of pressurized hydraulic fluid (not shown) via various conduits (not shown) and valves (not shown) to enable the movement of the sliding sleeve 10A axially within the valve body 10R from a closed position to an open position (or vice-versa) via application of hydraulic fluid power. Pressurized hydraulic fluid may be supplied to the lower hydraulic fluid inlet/outlet 54 to move the sliding sleeve 10A from its lowermost and closed position within the body (see FIG. 1) to its uppermost and open position within the body 10R (see FIG. 2), as any hydraulic fluid above the piston may be allowed to bleed off via the upper hydraulic fluid inlet/outlet 56. This operation may be reversed to move the sliding sleeve 10A from its open position (see FIG. 2) to its closed position (see FIG. 1). That is, pressurized hydraulic fluid may be supplied to the upper hydraulic fluid inlet/outlet 56 to move the sliding sleeve 10A from its open position (see FIG. 2) to its closed position (see FIG. 1), as any hydraulic fluid below the piston may be exhausted via the lower hydraulic fluid inlet/outlet 54. As noted above, when the sliding sleeve valve 10 is closed, fluid communication between the first flow bore 20 and the second flow bore 22 is blocked. However, when the sliding sleeve valve 10 is open, fluid communication between the first flow bore 20 and the second flow bore 22 is established. Additionally, as noted above, when the sliding sleeve valve 10 is closed (and the fluid flow ports 12, 14, 16 and 18 are not blocked), both the first and second flow bores 20, 22 are open. Of course, as will be appreciated by those skilled in the art after a complete reading of the present application, the movement of the sliding sleeve 10A may be accomplished by means other than hydraulic pressure. For example, the valve 10 and the sliding sleeve 10A could be configured such that it is adapted for mechanical actuation by various known mechanical means.

Figure 4:
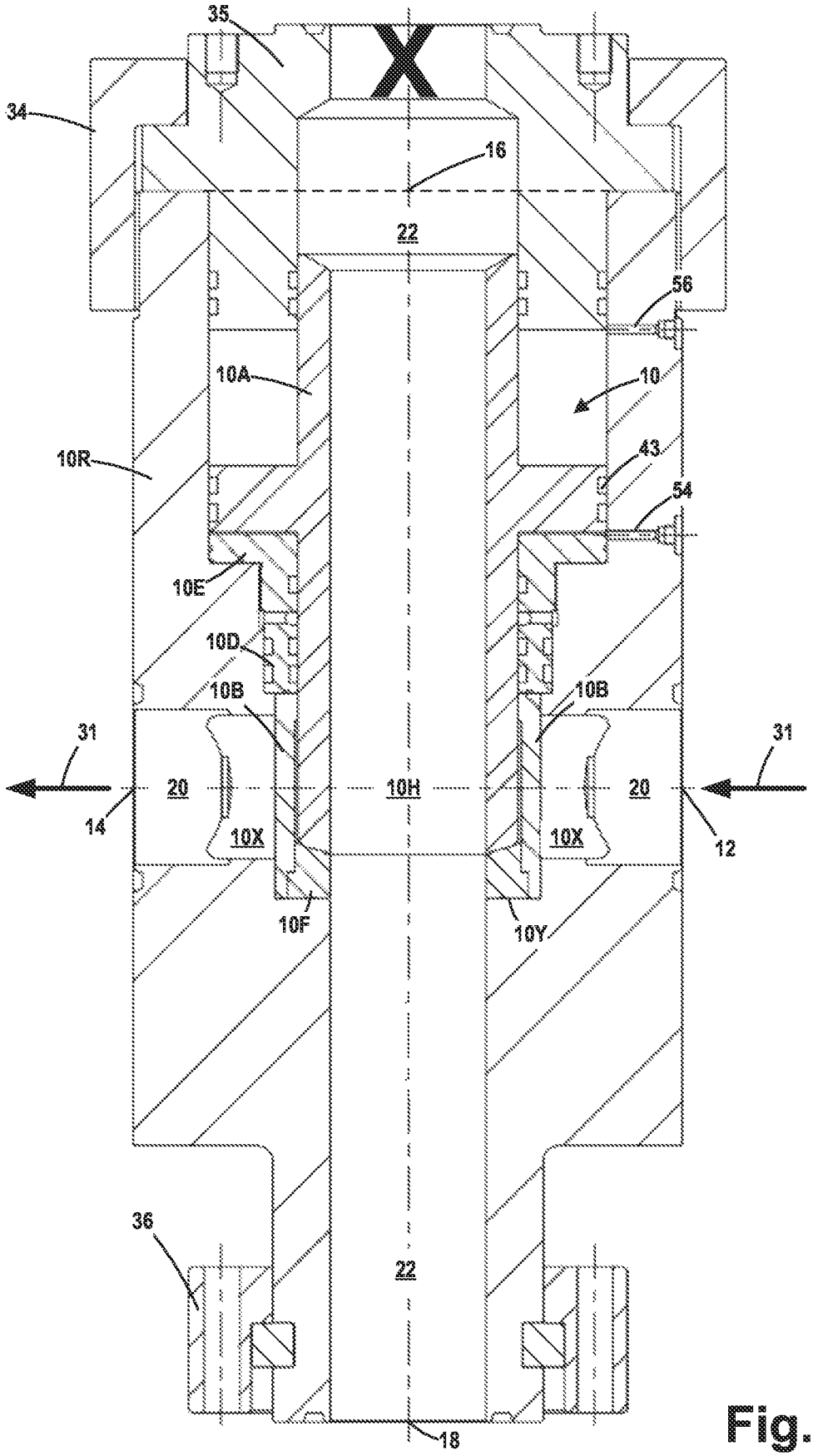
Figure 6:
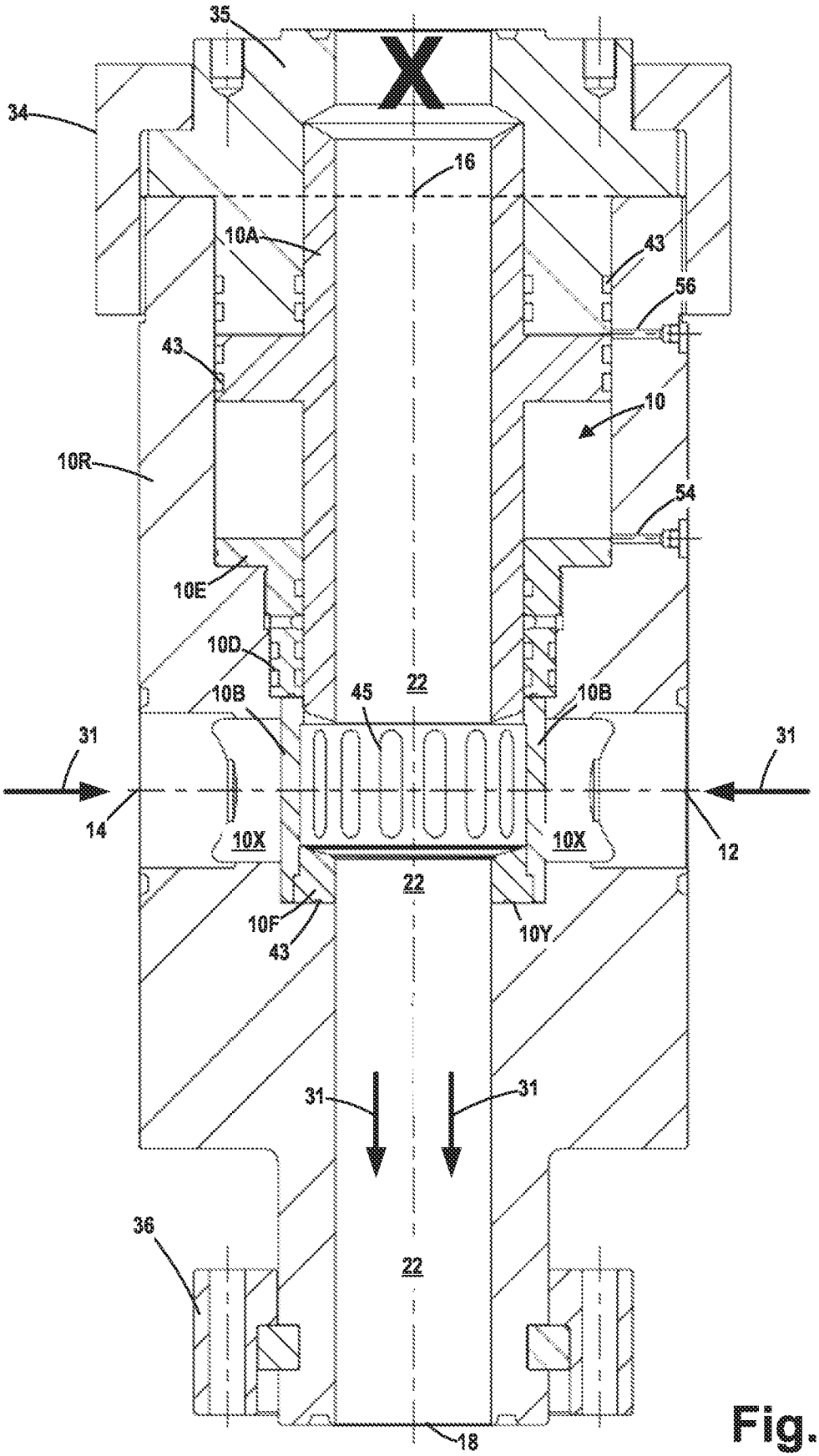

FIGS. 4-7 are provided to depict one illustrative operational configuration for the sliding sleeve valve 10. In FIGS. 4-7, it is assumed that the upper fluid flow port 16 is blinded off or otherwise blocked as reflected by the large "X" positioned proximate the upper fluid flow port 16. FIGS. 4 and 5 depict the situation when the valve 10 is closed, while FIGS. 6 and 7 depict the situation when the valve 10 is open. The first flow bore 20, the second flow bore 22, the fluid flow port 12, the fluid flow port 14 and the fluid flow gallery 10X in the valve body 10R are also schematically depicted in FIGS. 5 and 7.

Additional details regarding one illustrative embodiment of the wear sleeve 10B will be discussed more fully with reference to these drawings. More specifically, in some applications, the openings 45 may or may not extend around the entire outer perimeter of the wear sleeve 10B. For example, FIGS. 4-7 depict an embodiment of the wear sleeve 10B wherein the openings 45 (not shown in FIGS. 5 and 7) are formed in only portions or certain arcuate regions of the outer perimeter of the wear sleeve 10B, More specifically, with reference to FIGS. 5 and 7, the wear sleeve 10B may comprise four arcuate regions: arcuate regions 37A-B (collectively referenced using the numeral 37) and arcuate regions 47A-B (collectively referenced using the numeral 47). In this illustrative embodiment, the openings 45 are formed only in the arcuate regions 47 of the wear sleeve 10B, while the arcuate regions 37 of the wear sleeve 10B are free of any of the openings 45. Stated another way, in this embodiment, the openings 45 are positioned in the arcuate regions 47 that are substantially transverse to the centerlines of the fluid flow port 12 and the fluid flow port 14. Of course, if desired, the openings 45 may be positioned around the entirety of the perimeter of the wear sleeve 10B.

FIGS. 4 and 5 depict the valve 10 in its closed position wherein fluid communication between the first flow bore 20 and the second flow bore 22 is blocked. As shown therein, an illustrative fluid 31, e.g., frac fluid, enters the first flow bore 20 via the fluid flow port 12, flows into the fluid flow gallery 10X and exits the valve 10 via the fluid flow port 14. That is, in this example, with the valve 10 closed, the fluid 31 flows through the valve 10 via the first flow bore 20 and the fluid 31 bypasses the second flow bore 22. Of course, the illustrative direction of the flow of the fluid 31 could be reversed if desired. With the valve 10 closed, the fluid 31 that enters the first flow bore 20 is prevented from flowing into the second flow bore 22. The fluid 31 that enters the first flow bore 20 of the valve 10 via the flow port 12 impinges on the opening-free arcuate surface 37B of the wear sleeve 10B. In one illustrative example, having the entering fluid 31 impact the opening-free arcuate surface 37B tends to preserve the outer surface of the sliding sleeve 10A from excessive wear due to erosion, and thus improves the useful life of the sliding sleeve 10A. Thereafter, the fluid 31 splits into flow streams 31X and 31Y and flows around the wear sleeve 10B within the fluid flow cavity 10X until it recombines and exits the valve body 10R (and the first flow bore 20) via the fluid flow port 14. The fluid flow gallery 10X is sized so as to insure that the velocity of the fluid 31 flowing through the fluid flow gallery 10X does not exceed a pre-established desired level so as to reduce erosion of the components of the valve 10. As will be appreciated by those skilled in the art after a complete reading of the present application, another aspect of the valve 10 disclosed herein is that, when the valve 10 is in the closed position, the first flow bore 20 is fully isolated from the second flow bore 22, and both the first flow bore 20 and the second flow bore 22 are open. Such an arrangement allows both the first flow bore 20 and the second flow bore 22 to be used simultaneously. For example, in some applications, the second flow bore 22 may be used to perform certain downhole activities, e.g., setting casing plugs, creating perforations in the well casing by wireline, injection of chemicals into the formation, etc., while a fluid is flowing through the first flow bore 20.

With reference to FIGS. 6 and 7, with the sliding sleeve valve 10 in its open position, fluid communication between the first flow bore 20 and the second flow bore 22 is now established. As a result, fluid 31 enters the first flow bore 20 via both of the fluid flow ports 12 and 14 wherein it impinges on the opening-free solid surfaces 37B, 37A, respectively, of the wear sleeve 10B. The fluid stream 31 again splits into flow streams 31X and 31Y. However, with the sliding sleeve valve 10 open, the flow streams 31X and 31Y flow through the openings 45 in the wear sleeve 10B, into the second flow bore 22 of the valve 10 and downward toward the fluid flow port 18 (see FIG. 6). Flow of the fluid 31 out of the upper fluid flow port 16 is blocked. The quantity of the entering fluid 31 that flows into the second flow bore 22 when the sliding sleeve valve 10 is open may vary depending upon the particular application. For example, in some applications, substantially all of the fluid 31 that enters the first flow bore 20 of the valve 10 via both of the fluid flow ports 12, 14 may flow into the second flow bore 22 when the sliding sleeve valve 10 is open. This is the illustrative situation schematically shown in FIG. 7.

However, as will be appreciated by those skilled in the art after a complete reading of the present application, in some applications, the wear sleeve 10B (or other forms of a perforated member) may be omitted from the sliding sleeve valves 10 disclosed herein. For example, horizontally oriented seals (not shown), e.g., O-rings, may be provided in the valve body 10R above and below the fluid flow cavity 10X so as to sealingly engage the outer circumference of the sliding sleeve 10A, wherein the upper seal engages the sliding sleeve 10A when the valve 10 is in its uppermost open position and both of the seals engage the sliding sleeve 10A when the valve is in its lowermost closed position. Of course, other configurations and locations of the seals may also be provided. Thus, in this example, when the sliding sleeve 10 is moved to its uppermost open position within the valve body 10R, the fluid 31 entering the first flow bore 20 of the valve 10 via the fluid flow ports 12, 14 may simply flow into the second flow bore 22 in the valve 10.

Figure 8:
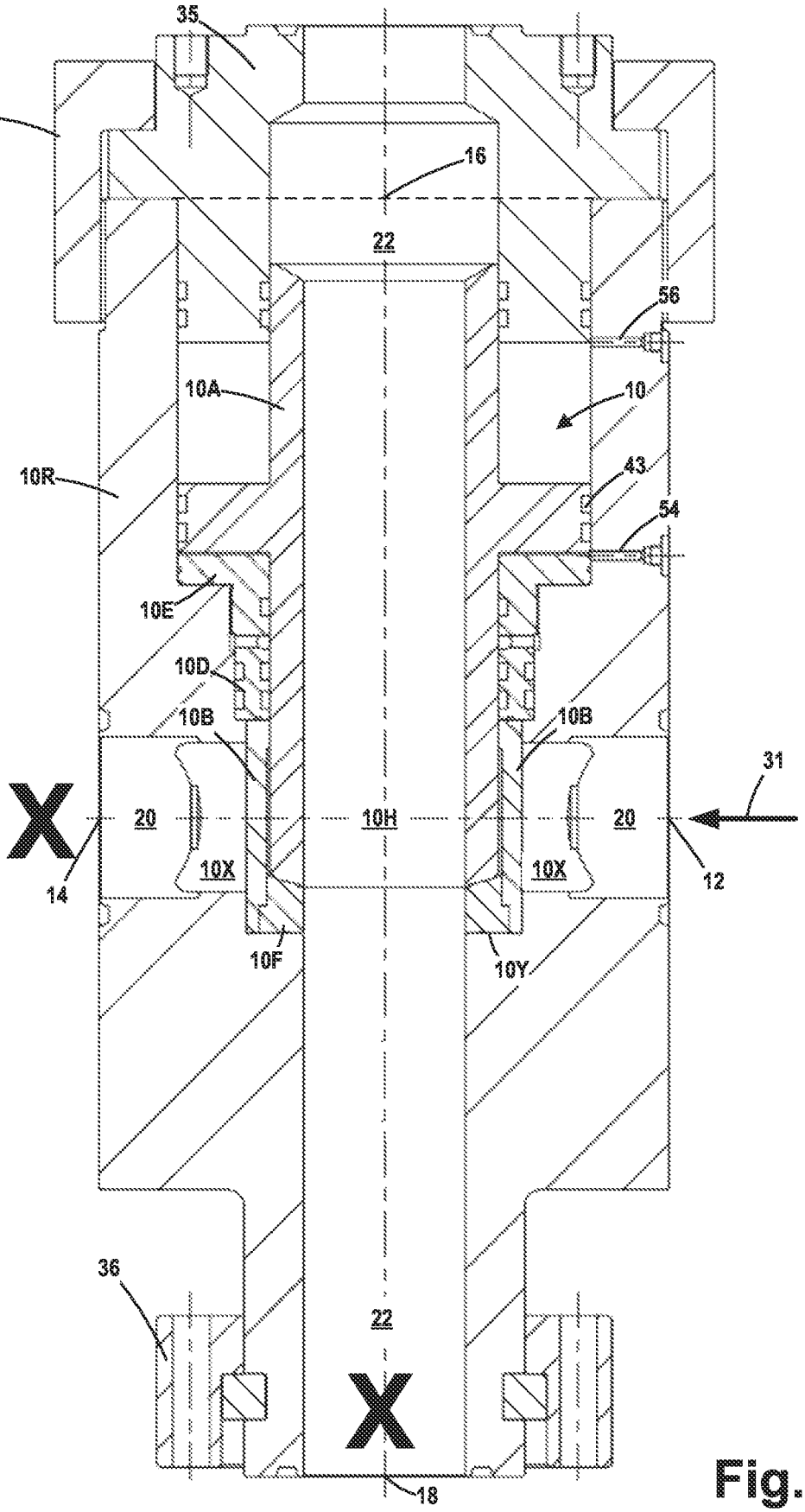
Figure 9:
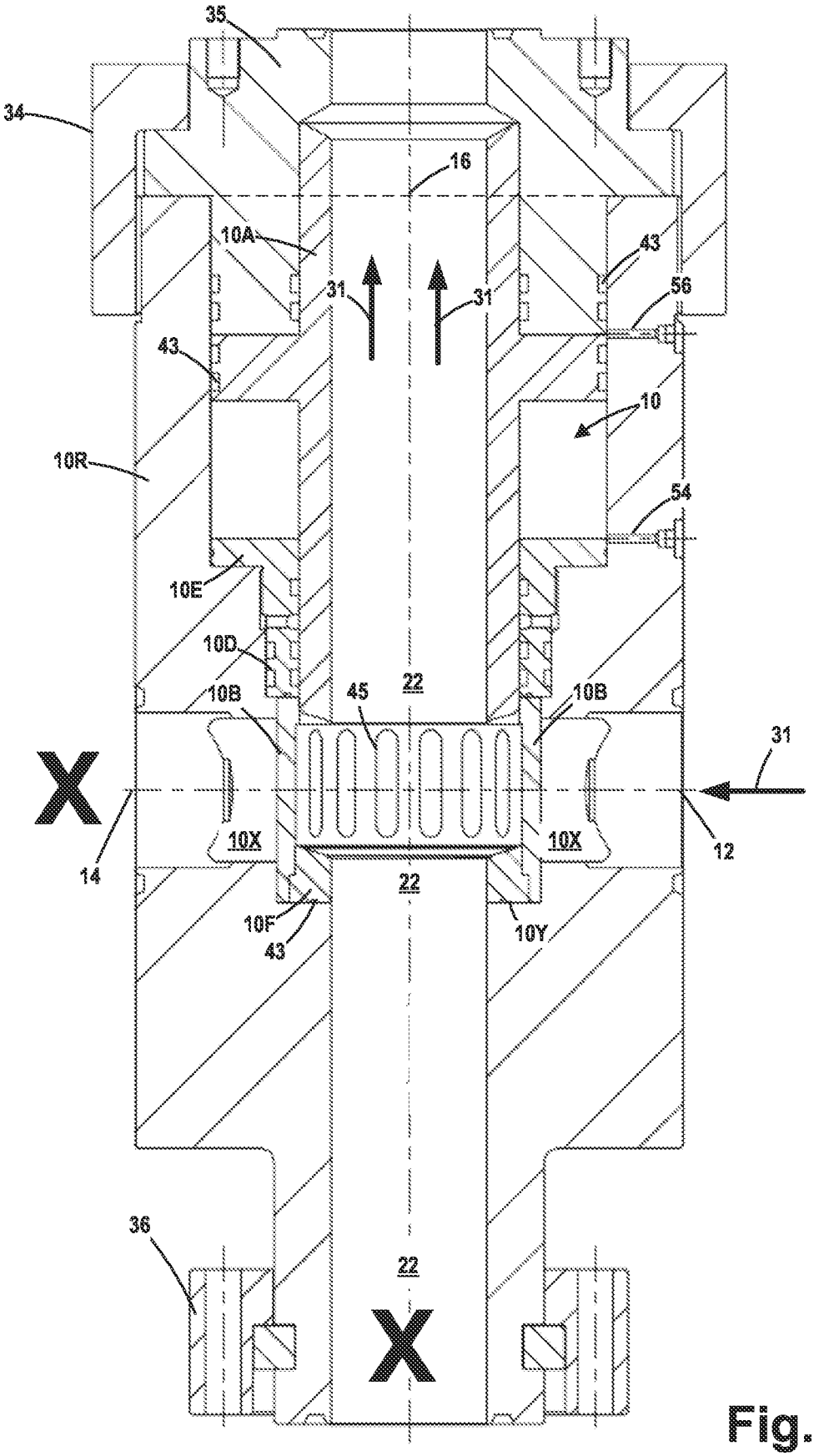

FIGS. 8-9 are provided to depict another illustrative operational configuration for the sliding sleeve valve 10. In FIGS. 8-9, it is assumed that fluid flow ports 14 and 18 are blinded off or otherwise blocked as reflected by the large "X" positioned proximate the fluid flow ports 14 and 18. FIG. 8 depicts the valve 10 in its closed position wherein fluid communication between the first flow bore 20 and the second flow bore 22 is blocked. As shown therein, the illustrative fluid 31 enters the first flow bore 20 via the fluid flow port 12 and flow into the fluid flow gallery 10X, but it is blocked from entering the second flow bore 22 and also blocked from flowing through the valve 10 due to the blockage of the fluid flow port 14.

With reference to FIG. 9, with the sliding sleeve valve 10 in its open position, fluid communication between the first flow bore 20 and the second flow bore 22 is now established. As a result, the fluid 31 that enters the first flow bore 20 via the fluid flow port 12 flows through the openings 45 in the wear sleeve 10B, into the second flow bore 22 and exits the valve 10 via the fluid flow port 16. The fluid 31 cannot flow through the fluid flow portions 14, 18 as they have been blocked. As will be apparent to those skilled in the art after a complete reading of the present application, the sliding sleeve valves 10 disclosed herein may be used in a variety of operational configurations that are tailored to the particular application.

Figure 10:
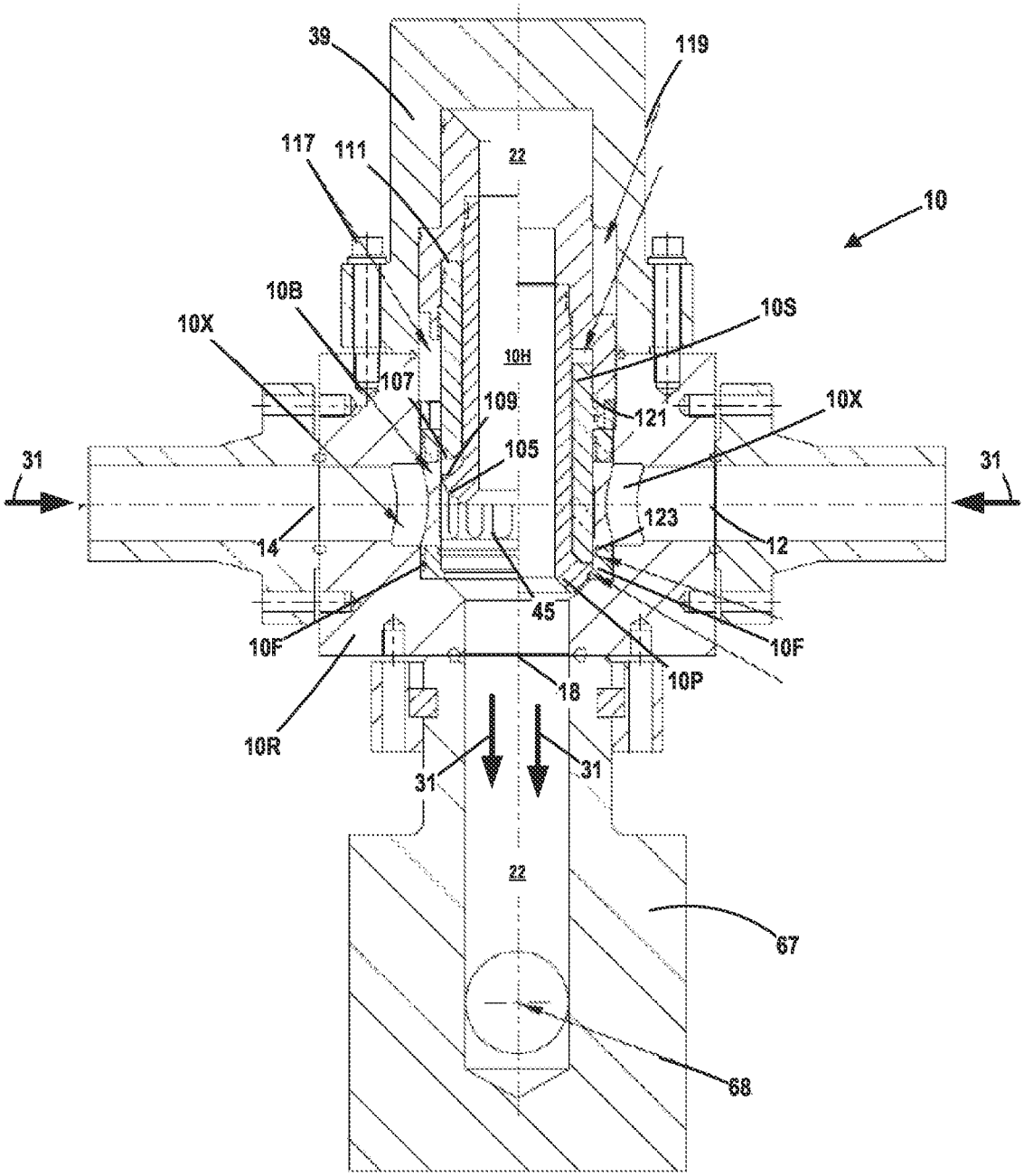

FIG. 10 depicts another illustrative embodiment of a sliding sleeve valve 10 disclosed herein. Among other things, this illustrative embodiment of the sliding sleeve valve 10 comprises two sliding sleeves 10P, 10S that are at least partially positioned in the valve body 10R as compared to the previously disclosed embodiment of the valve 10 that comprises only a single sliding sleeve 10A. In the illustrative example shown in FIG. 10, the sliding sleeve valve 10 comprises the above-described fluid flow gallery 10X, a primary sliding sleeve 10P, a secondary sliding sleeve 108 and the above-described wear sleeve 10B. However, as noted above, the wear sleeve 10B may be omitted in some applications. The left side of FIG. 10 depicts the valve 10 in its open position while the right side of FIG. 10 depicts the valve 10 in its closed position.

The primary sliding sleeve 10P and the secondary sliding sleeve 10S are adapted to be shifted axially at least partially within the body 10R of the valve 10 by application of hydraulic pressure to various hydraulic chambers as described more fully below. Of course, as noted above, movement of the primary sliding sleeve 10P and the secondary sliding sleeve 10S may be accomplished by means other than hydraulic pressure. As will be appreciated by those skilled in the art after a complete reading of the present application, the primary sliding sleeve 10P and the secondary sliding sleeve 10S, when considered collectively, are adapted to be moved within the body of the valve 10 from a closed position to an open position, and vice-versa. As before, when the valve 10 is in the closed position, fluid communication between the first flow bore 20 and the second flow bore 22 is blocked. However, when the valve 10 is in the open position, fluid communication between the first flow bore 20 and the second flow bore 22 is established.

In the illustrative example, the upper fluid flow port 16 is effectively blinded by a cap 39 that is operatively coupled to the valve body 10R. Thus, in one illustrative configuration, when the valve 10 is in its open position, fluid 31 that enters the valve 10 via the flow ports 12 and 14 flows into the fluid flow gallery 10X, flows through the openings 45 in the wear sleeve 10B and downward into the second flow bore 22 where it exits the valve 10 via the fluid flow port 18. In this illustrative example, the valve 10 is coupled to an optional block 67 that includes a dedicated fluid outlet 68 that is adapted to receive the fluid 31 that exits the fluid flow port 18 in the valve 10. In some applications, the outlet 68 may be dedicated to supplying fracturing fluid to a particular well. When the valve 10 is in its closed position, fluid 31 entering the valve 10 is blocked from flowing into the second flow bore 22 of the valve 10, and the fluid 31 simply flows through the fluid flow gallery 10X and bypasses the valve 10.

To move the valve 10 from its open position to its closed position, hydraulic pressure is supplied to a hydraulic chamber 119 to force the primary sliding sleeve 10P into its closed position wherein an end surface 105 on the primary sliding sleeve 10P sealingly engages the seat 10F. At that point, hydraulic pressure is supplied to another hydraulic chamber 121 to drive the secondary sliding sleeve 10S into sealing engagement with a radial elastomer seal 123, thereby creating a secondary barrier between the first flow bore 20 and the second flow bore 22. As will be appreciated by those skilled in the art after a complete reading of the present application, when the valve 10 is in its closed position, the secondary sliding sleeve 10S provides a secondary block or barrier to fluid communication between the first flow bore 20 and the second flow bore 22, thereby providing a second barrier that prevents the flow of fluid 31 into the second flow bore 22.

To move the valve 10 from its closed position to its open position, the hydraulic chamber 121 is vented thereby releasing the secondary sliding sleeve 10S so it can be moved. At that point, hydraulic pressure is supplied to the hydraulic chamber 117 to drive the secondary sliding sleeve 10S, then the primary sliding sleeve 10P to the fully retracted position shown on the left side of FIG. 10. Pressure may be maintained within the chamber 117 to hold the valve 10 in its fully open position.

As noted above, the various embodiments of the illustrative sliding sleeve valves 10 disclosed herein may be employed in a variety of different systems and used for a variety of different purposes in a variety of different applications. FIGS. 11-21 depict various examples where the sliding sleeve valves 10 disclosed herein may be employed in systems adapted for fracturing oil and gas wells.

Figure 11:
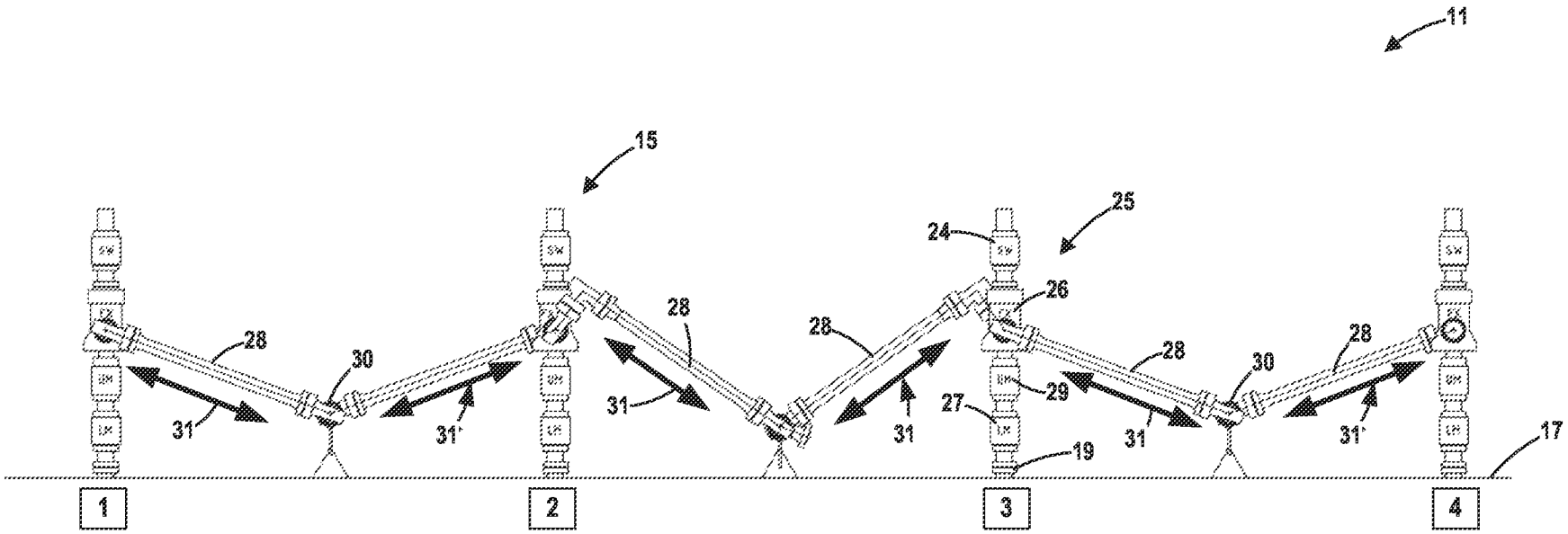
Figure 12:
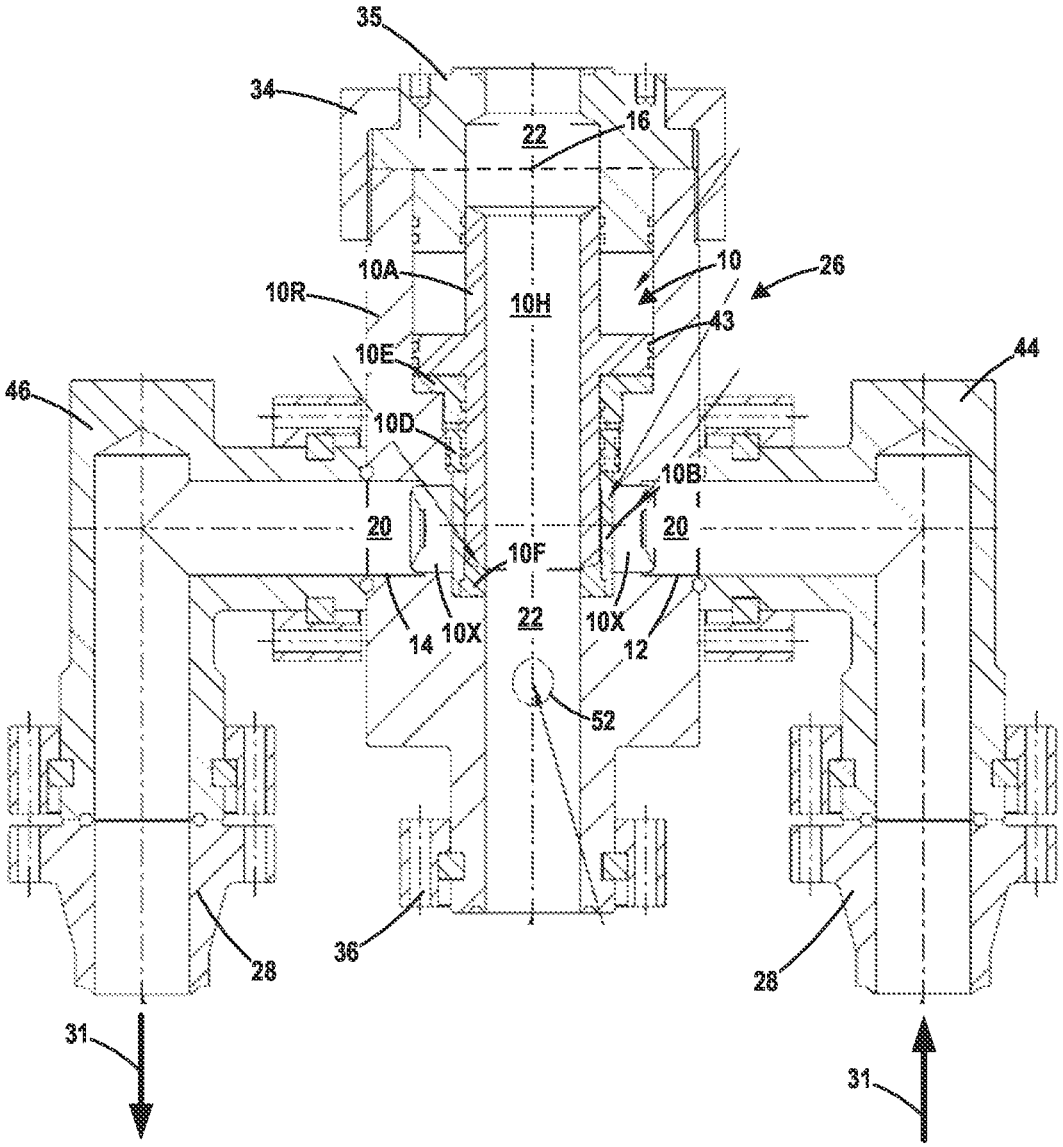
Figure 13:
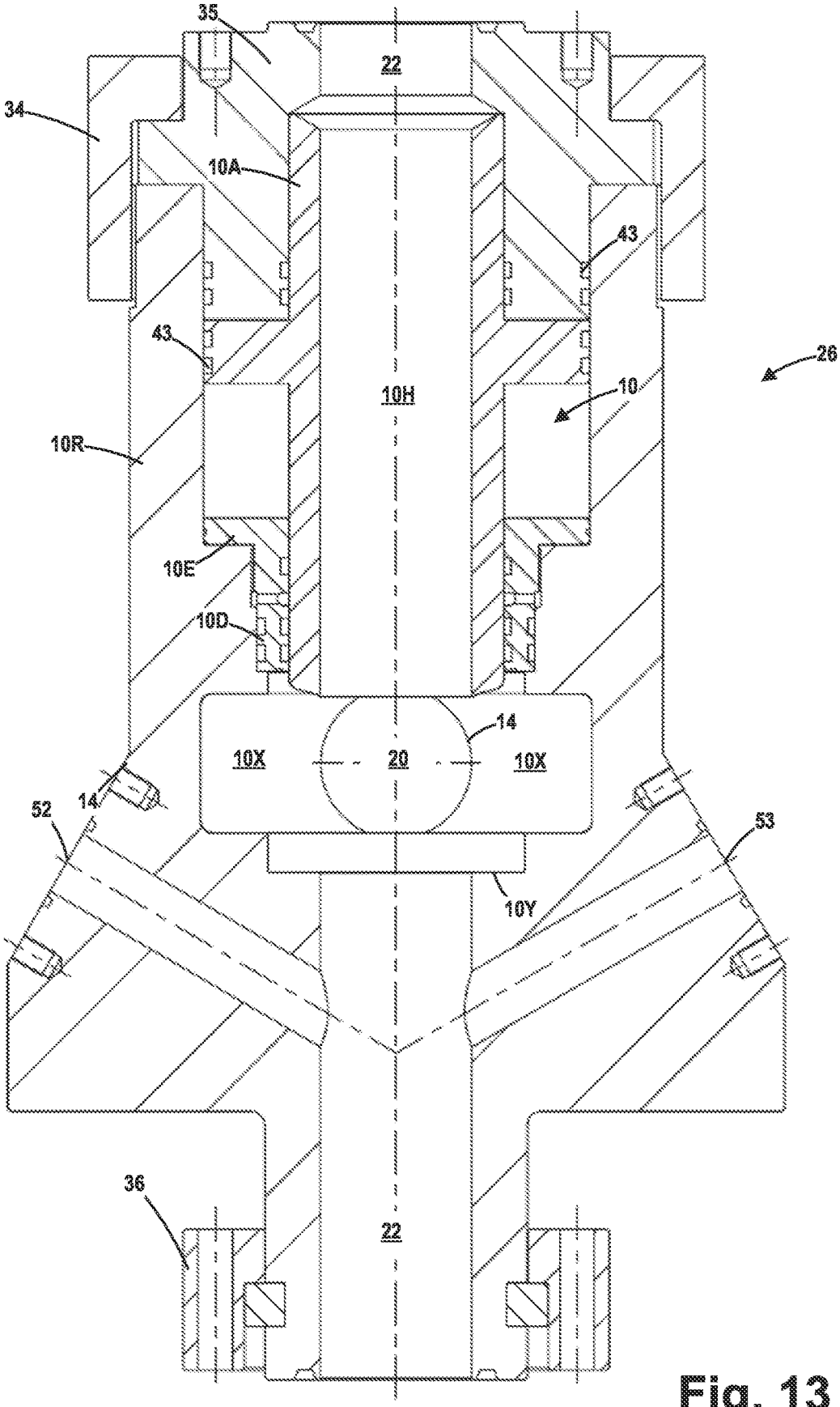

FIGS. 11-13 depict one illustrative system 11 that comprises a plurality of oil and/or gas wells 15 that extend beneath a surface 17 of the earth, wherein fracturing operations may be performed on one or more of the wells 15. Although only four illustrative wells 15 (labeled 1-4 for reference purposes) are depicted in this example, after a complete reading of the present application, those skilled in the art will understand and appreciate that the system 11 may comprise any desired number of wells 15. Each well 15 comprises a wellhead 19 and a production tree 25 that is operatively coupled to the wellhead. In the depicted example, each of the production trees 25 comprises a lower master valve ("LM") 27, an upper master valve ("UM") 29, a swab valve ("SW") 24 and a flow cross block ("FX") 26. In the system shown in FIG. 11, the sliding sleeve valves 10 disclosed herein are positioned in the flow cross block 26. As depicted, in this example, the flow cross block 26 is positioned vertically between the swab valve 24 and the upper master valve 29.

Also depicted in FIG. 11 is a fluid flow conduit system that comprises a plurality of simplistically depicted flow conduits 28 that are adapted to provide a flow path for fracturing fluid 31 that will be provided to the wells 15. In one illustrative embodiment, the flow conduits 28 may take the form of traditional piping. In other applications, some or all of the flow conduits 28 may take the form of a flexible hose. Also depicted in FIG. 11 is a plurality of shared inlet manifolds 30 that are in fluid communication with the fluid flow conduit system. The shared inlet manifolds 30 are also in fluid communication with a source (not shown) of high-pressure fracturing fluid 31. In the example shown herein, adjacent sections of the fluid conduits 28 are in fluid communication with a shared inlet manifold 30. The mechanical coupling or connection between and among the components depicted in FIG. 11 may be accomplished in any of a variety of different means or mechanisms, e.g., flanged connections.

As noted above, in the illustrative system 11 shown in FIG. 11, each of the flow cross blocks 26 comprises one of the sliding sleeve valves 10 disclosed herein. The valves 10 incorporated into the flow cross blocks 26 may be either the dual sliding sleeve embodiment of the sliding sleeve valves 10 (see FIG. 10) or they may be the single sliding sleeve embodiment of the valves 10 (see FIGS. 1-3). In this situation, the body of the flow cross block 26 corresponds to the body 10R of the sliding sleeve valve 10 and the second flow bore 22 of the valve 10 is axially aligned with the production flow bore of the well 15. FIG. 12 is a cross-sectional view of the flow cross block 26 and the valve 10 with the valve 10 in its closed position. FIG. 13 is a cross-sectional view of the flow cross block 26 and the valve 10 with the valve 10 in its open position. The cross-sectional view shown in FIG. 13 is rotated ninety degrees relative to the cross-sectional view shown in FIG. 12. The wear sleeve 10B and valve seat 10F are not depicted in FIG. 13. The fluid flow conduit system is operatively coupled to the first flow bore 20 in each of the plurality of production trees 25 so as to provide fluid communication between the first flow bore 20 in each of the plurality of production trees 25.

With reference to FIGS. 12-13 (depicting the single sliding sleeve version of the valve 10 by way of example only), the above-described illustrative cap 35 is coupled to the upper end of the body of the flow cross block 26 by some form of a connector 34, e.g., a threaded or clamped connection. A lower flange 36 is provided on the flow cross block 26 such that it may be operatively coupled (directly or indirectly) to the upper master valve 29. As shown in FIG. 12, simplistically depicted fluid inlet piping 44 and fluid outlet piping 46 is operatively coupled to the fluid flow port 12 and the fluid flow port 14, respectively. The inlet and outlet piping 44, 46 are also operatively coupled to flanges on illustrative sections of the flow conduits 28. The various connections between and among the components shown in FIGS. 11-13 may be accomplished using any of a variety of known techniques and means, e.g., flanged connections, threaded connections, clamped connections, etc.

With reference to FIGS. 12 and 13, first and second wing conduits 52, 53 may be formed in the flow cross block 26. In the depicted example, the wing conduits 52 and 53 are in fluid communication with the second flow bore 22 and the production bore that extends through the flow cross block 26. The wing conduits 52, 53 may serve a variety of different purposes depending upon the particular application, e.g., one of the wing conduits may function as a production outlet. In the example depicted herein, the sliding sleeve valve 10 is positioned vertically above the location where the wing conduits 52, 53 intersect the second flow bore 22. However, in other applications, the sliding sleeve valve 10 may be positioned vertically below the location where the wing conduits 52, 53 intersect the second flow bore 22.

The system 11 depicted in FIG. 11 is adapted to distribute simplistically depicted fracturing fluid 31 between and among the wells 15 on an as needed basis. As depicted, in one illustrative example, with all of the valves 10 closed, and with proper venting, high-pressure fracturing fluid 31 may be supplied to all of the inlet manifolds 30, all of the flow conduits 28 and the first flow bore 20 (which include the flow gallery 10X) of all of the valves 10 in the system. The source of high-pressure fracturing fluid (not shown), e.g., a frac manifold, will be operatively coupled to the inlet manifolds 30 by some form of fluid flow conduit (not shown), e.g., pipe or flexible hose. The ultimate source of the pressurized fracturing fluid 31 may take a variety of forms, e.g., a collection of high-pressure pumps, as the system 11 is adapted to receive high-pressure fracturing fluid 31 from any type or source of pressurized fracturing fluid. As will be appreciated by those skilled in the art after a complete reading of the present application, when closed, the sliding sleeve valve 10 in each of the production trees 25 isolates the second flow bore 22 of the sliding sleeve valve 10 and ultimately the production bore of each of the wells 15 from the first flow bore 20 that contains the high-pressure fracturing fluid 31.

After high-pressure fracturing fluid 31 is supplied to the system 11, the sliding sleeve valve 10 on a particular well may be moved from its closed positon to its open position. At that point, the high-pressure fracturing fluid 31 within the system 11 flows into the second flow bore 22 in sliding sleeve valve 10 for that particular well via one or both of the fluid flow ports 12, 14 in the flow cross block 26 above that particular well. The fracturing fluid 31 continues to flow through the openings 45 in the illustrative wear sleeve 108, into the second flow bore 22 for that particular valve 10 and ultimately into the production bore of that particular well, i.e., fracturing operations may be performed on that particular well when the sliding sleeve valve 10 of that particular well is open. Thus, fracturing fluid 31 is simplistically depicted with double arrows in FIG. 11 given the fact that the fracturing fluid 31 may flow in either direction within the first flow bore 20 (i.e., the flow ports 12, 14 and the flow gallery 10X) depending upon the operational state of the system 11 at any particular point in time.

When the sliding sleeve valve 10 on a particular well is in its closed position, fracturing fluid 31 that enters the first flow bore 20 in the valve 10 (via either the fluid flow port 12 or the fluid flow port 14) flows through the first flow bore 20 for that particular valve, bypasses that particular well and flows downstream to the first flow bore 20 of the valve 10 in the adjacent downstream well 15. That is, when the sliding sleeve valve 10 is in its closed position, fracturing fluid 31 that enters the first flow bore 20 in the flow cross block 26 is blocked from entering the second flow bore 22 of that particular valve 10 and ultimately the production bore of that particular well. In effect, in the disclosed example, the wells 15 are chained together with respect to the flow of fracturing fluid 31 to and among all of the wells 15 in the system 11, i.e., there is fluid communication between the first flow bore 20 of each of the valves 10 above each of the wells 15 as it relates to the flow of fracturing fluid 31 within the system 11.

As will be appreciated by those skilled in the art after a complete reading of the present application, the system 11 disclosed herein provides field operators great flexibility as it relates to performing fracturing operations on the wells 15. In general, as noted above, with the sliding sleeve valve 10 of a particular well 15 closed, fracturing fluid 31 is allowed to bypass that particular well and flow to the adjacent downstream well. In some applications, the sliding sleeve valve 10 of only one well, e.g., well number 3, may be opened so as to provide fracturing fluid 31 to the production bore of well number 3 while the valves 10 in the flow cross blocks 26 of the other wells 1, 2, and 4 remain closed for fracturing operations. That is, fracturing operations may be performed on only the single well by selectively opening the sliding sleeve valve 10 for that particular well while leaving the sliding sleeve valve 10 closed on the other wells in the system 11 (e.g., wells 1, 2 and 4). In other applications, fracturing operations may be performed on two or more wells at the same time while blocking the flow of fracturing fluid 31 to the production bore of the other wells within the system 11. For example, the sliding sleeve valve 10 on wells 1 and 3 may be opened while the sliding sleeve valve 10 on wells 2 and 4 may be closed, thereby permitting fracturing operations to be selectively performed on only wells 1 and 3. This process may be modified by opening and closing certain of the valves 10 so as to direct the flow of fracturing fluid to one or more of the wells 1-4. The system 11 disclosed herein may also result in a more compact footprint for fracturing operations and may reduce the linear feet of flow conduits 28 for fracturing fluid 31 as compared to prior art fracturing systems.

Figure 14:
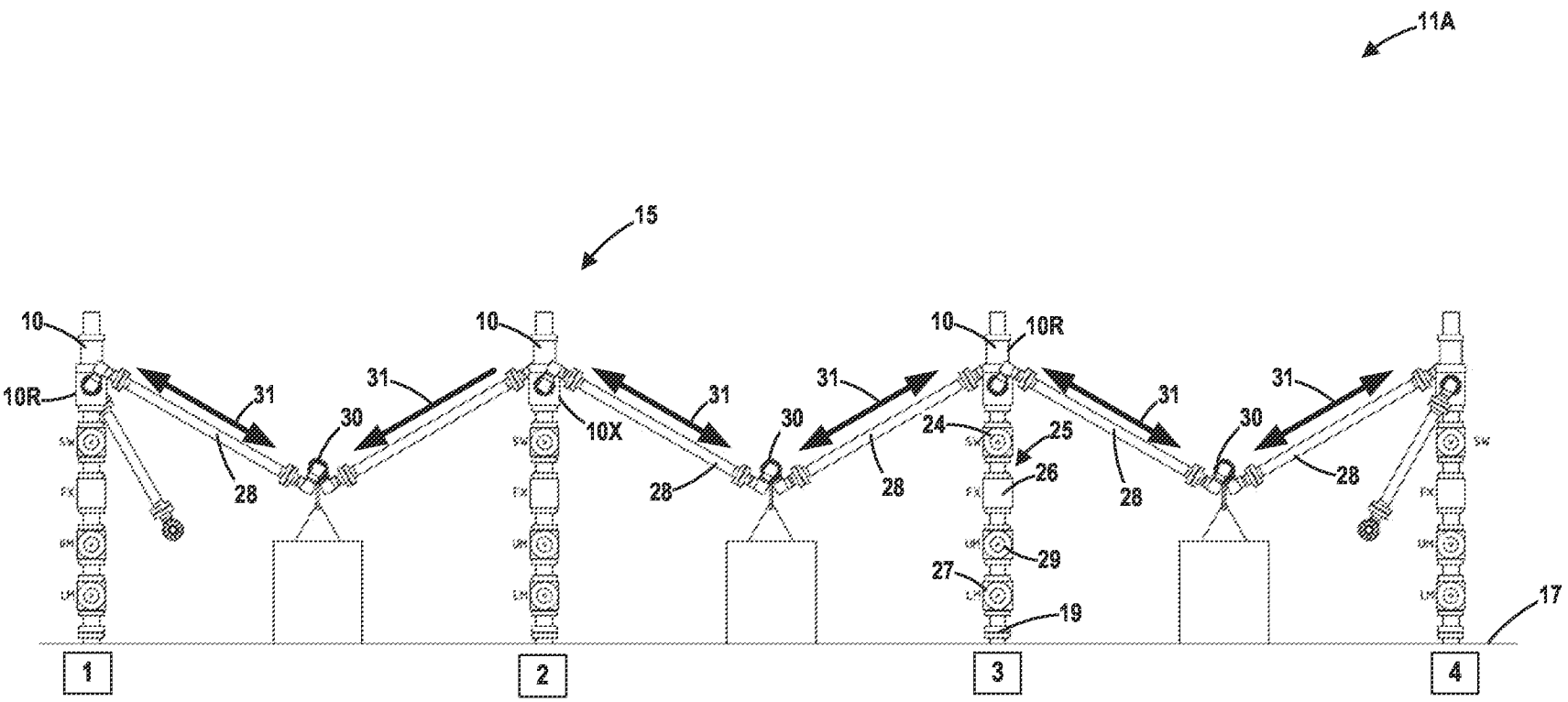

FIG. 14 depicts another illustrative embodiment of a system 11A for use when fracturing oil and gas wells 15. The system 11A shown in FIG. 14 is very similar to the system 11 shown in FIG. 11. However, in the illustrative system 11A, the sliding sleeve valve 10 is not located within the flow cross block 26 of the production tree 25. Rather, in the system 11A, the sliding sleeve valve 10 is positioned above the production tree 25. In the depicted example, the sliding sleeve valve 10 is positioned immediately above the swab valve 24. Of course, the sliding sleeve valve 10 may be positioned at a variety of different locations within the systems disclosed herein and they may be used for a variety of different purposes in the systems disclosed herein. As before, the valves 10 shown in the system 11A may be either the dual sliding sleeve embodiment of the sliding sleeve valves 10 (see FIG. 10) or they may be the single sliding sleeve embodiment of the valves 10 (see FIGS. 1-3).

Figure 15:
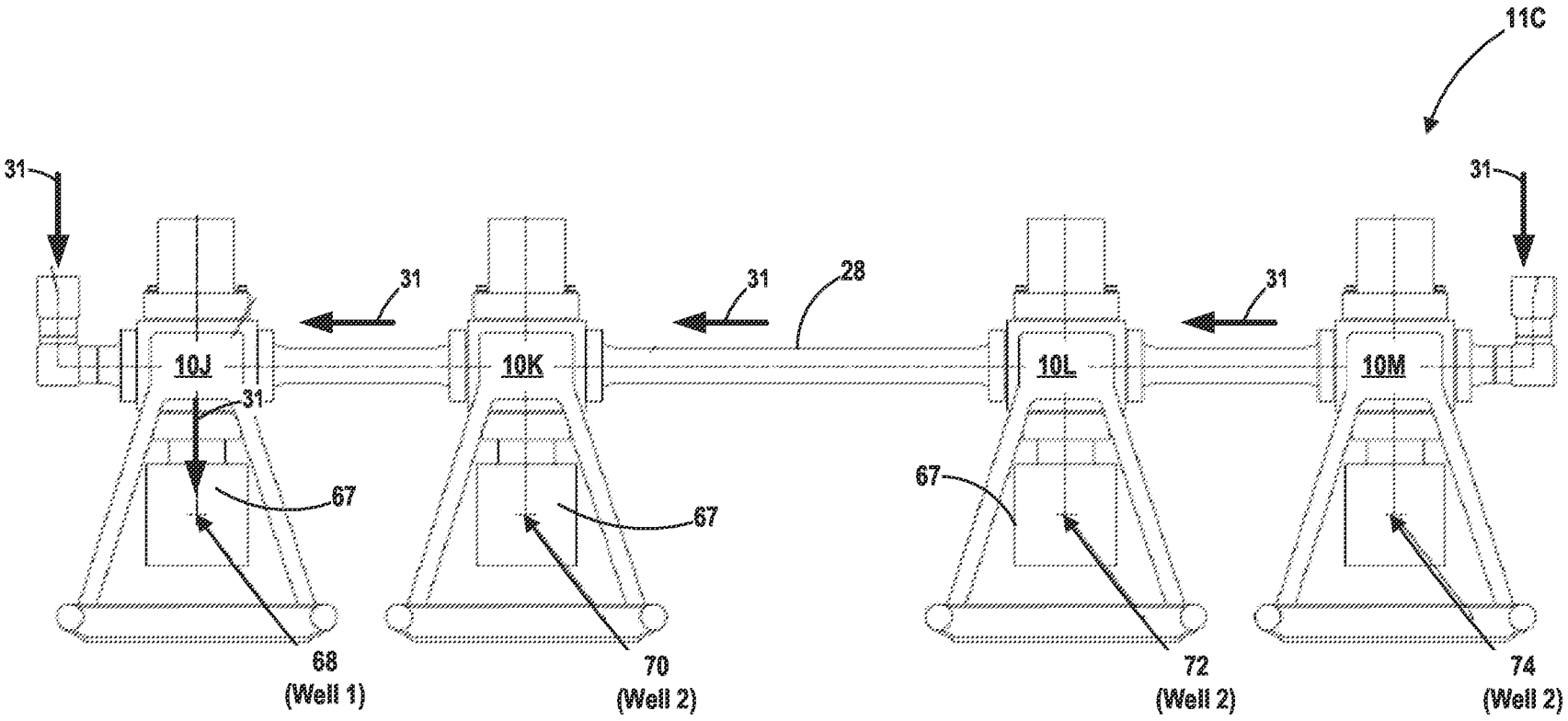

FIG. 15 depicts yet another illustrative system 11C for use in fracturing oil and gas wells. In this illustrative system, there are four illustrative sliding sleeve valves 10J-10M that are arranged with a common conduit 28 that allows the flow of fracturing fluid 31 to be shared by all of the valves 10J-10M. The valves 10J-10M may be either the dual sliding sleeve embodiment of the sliding sleeve valves 10 (see FIG. 10) or they may be the single sliding sleeve embodiment of the valves 10 (see FIGS. 1-3). The valves 10J-10M, respectively, are operatively coupled to a block 67 (see FIG. 10) that comprises a dedicated outlet 68, 70, 72 and 74, respectively, for suppling fracturing fluid 31 to one of the four illustrative wells. In the example depicted in FIG. 15, valve 10J will be opened so as to allow fracturing fluid 31 to flow into well number 1 while the valves 10K-M will be closed so as to prevent fracturing fluid 31 from entering the wells 2-4. This process may be modified by opening and closing certain of the valves 10J-10M so as to direct the flow of fracturing fluid to one or more of the wells 1-4.

Figure 16:
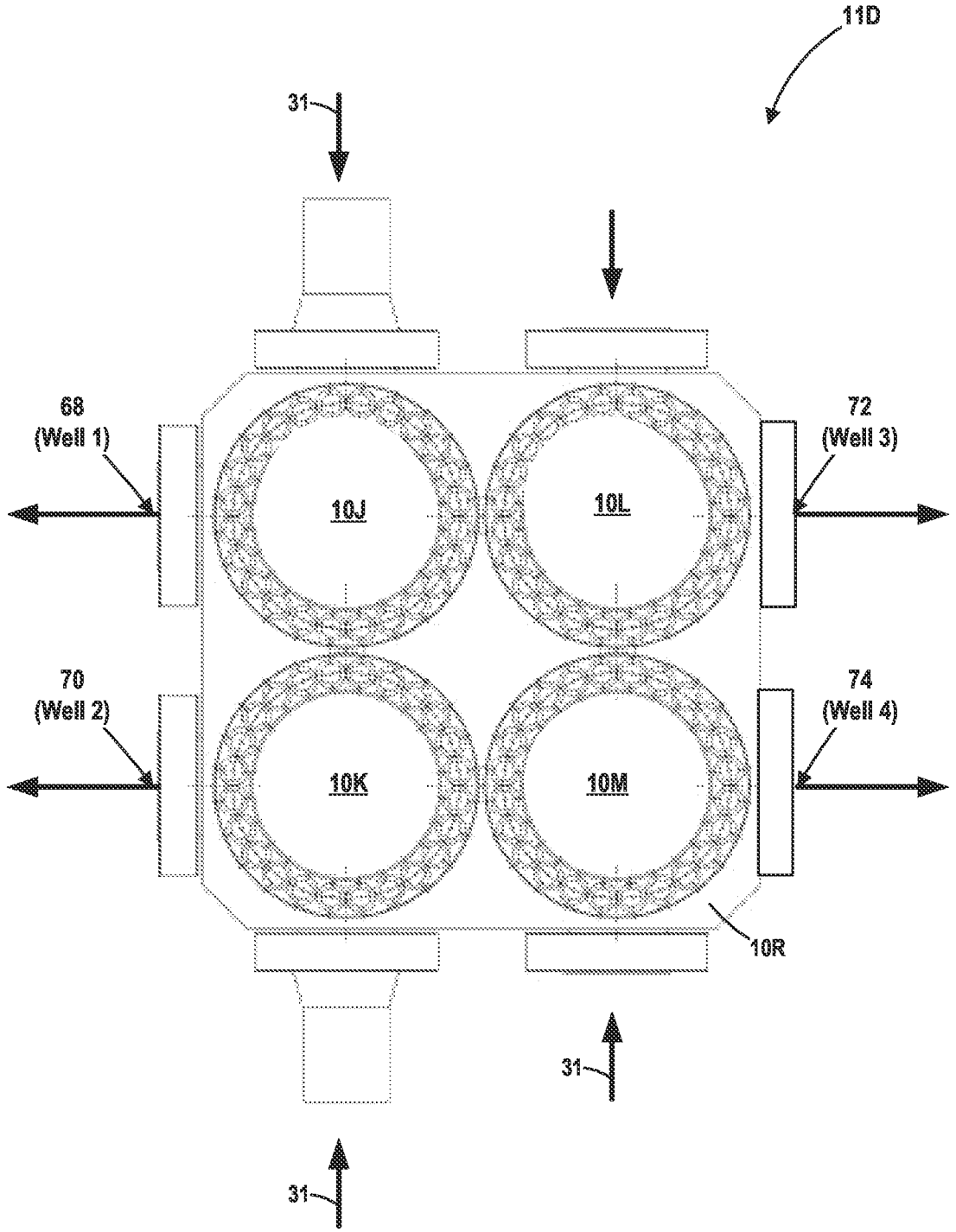
Figure 17:
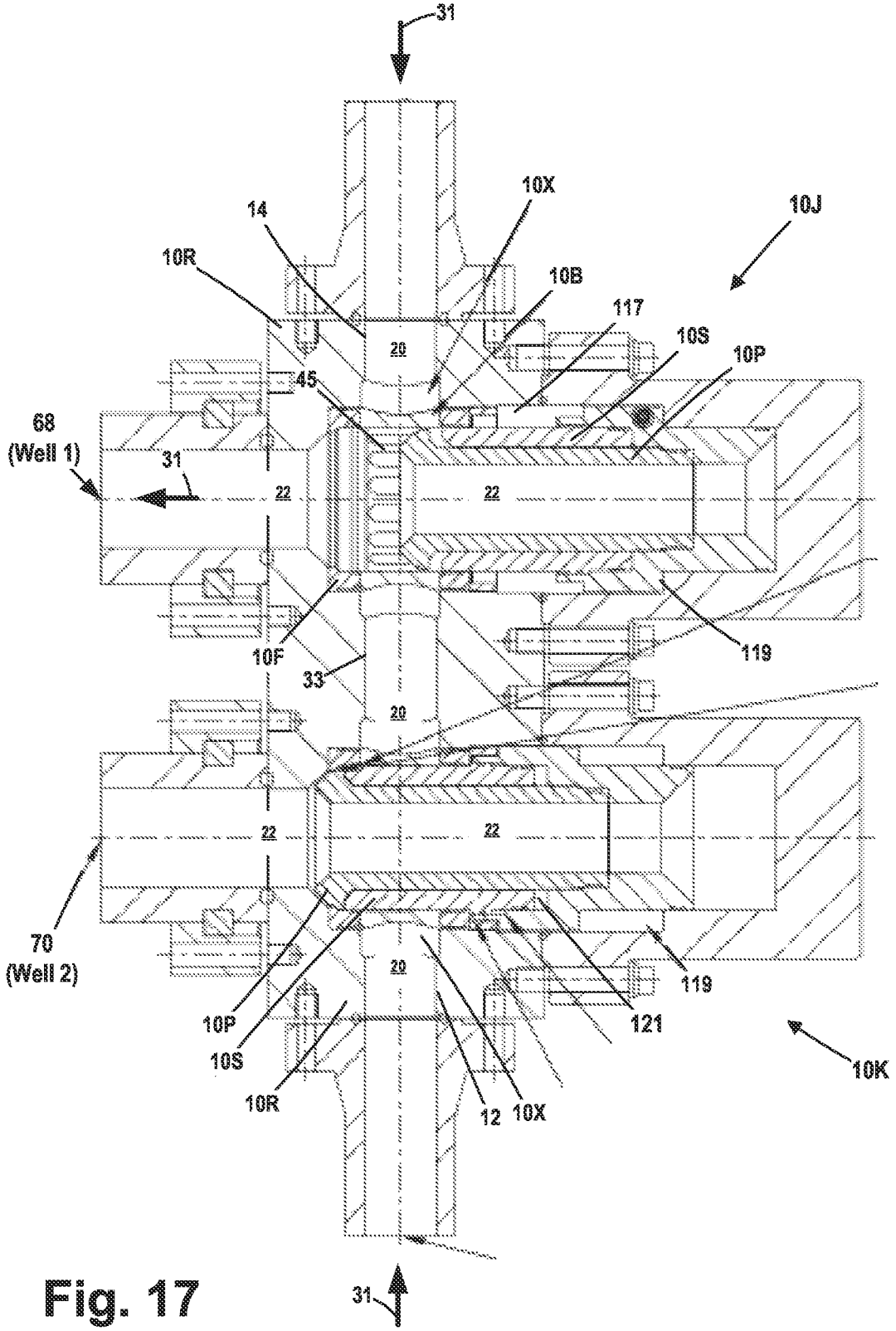

FIGS. 16-17 depict another illustrative system 11D for use in fracturing oil and gas. In this illustrative system, there are four of the above-described illustrative sliding sleeve valves 10J-1M that are positioned within a single unitary body 10R. The valves 10J-10M, respectively, comprise a dedicated outlet 68, 70, 72 and 74, respectively, for suppling fracturing fluid 31 to one of the four illustrative wells. FIG. 17 is a cross-sectional view of the valves 10J and 10K, but all of the valves 10 have the same configuration. The valves 10 shown in FIGS. 16-17 are the dual sliding sleeve embodiment of the sliding sleeve valves 10 disclosed herein (see FIG. 10). However, if desired, the valves 10 included in the system 11D could be the single sliding sleeve embodiment (see FIGS. 1-3). With reference to FIG. 17, the valves 10 include one of the above-described primary sliding sleeves 10P and one of the secondary sliding sleeves 10S.

Fracturing fluid 31 is introduced into the body of the first flow bore 20 of valve 10 via the fluid flow port 12 and the fluid flow port 14 which are in in fluid communication with the first flow bore 20 in each of the valves 10J, 10K, respectively. A shared internal flow conduit 33 within the body 10R provides fluid communication between the first flow bore 20 of the valves 10J-K. In this embodiment, the valves 10 include the above-described optional wear sleeve 108. The valve 10J is in its open position while valve 10K in its closed position. With the valve 10J open, the fracturing fluid 31 entering the valve 10J flows through the openings 45 in the wear sleeve 10B, into the second flow bore 22 of the valve 10J and out of the dedicated fluid outlet 68 to well 1, while the flow of fracturing fluid 31 to the other wells 2-4 is blocked. As before, this process may be modified by opening and closing certain of the valves 10J-10M so as to direct the flow of fracturing fluid to one or more of the wells 1-4.

Figure 18:
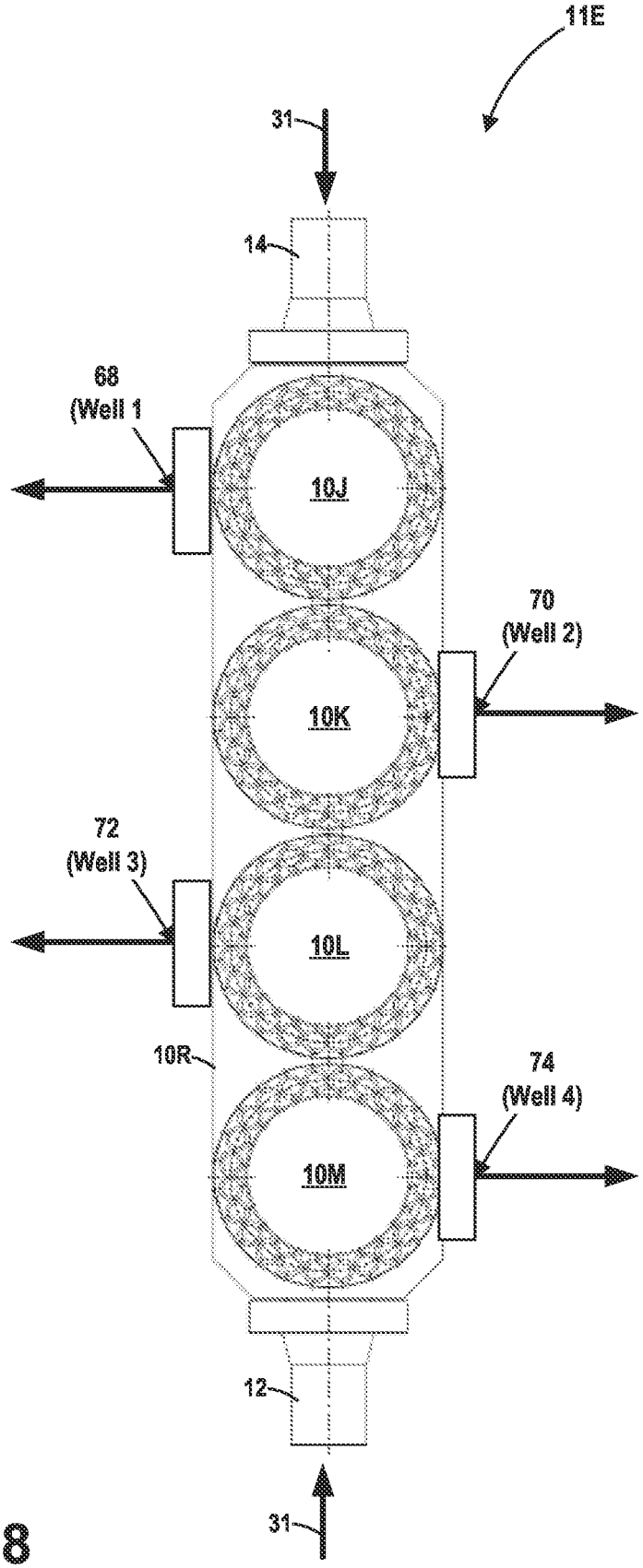

FIG. 18 depicts another illustrative system 11E for use in fracturing oil and gas wells. In this illustrative example, there are four of the above-described illustrative sliding sleeve valves 10J-10M that are arranged within a single unitary body 10R. The primary difference between the system 11E and the system 11D is that, in system 11E, all four of the valves 10J-10M are arranged in series. As before, the valves 10J-10M, respectively, comprise a dedicated outlet 68, 70, 72 and 74, respectively, for suppling fracturing fluid 31 to one of the four illustrative wells. As noted above, the valves 10 shown in FIG. 18 may be the dual sliding sleeve embodiment of the sliding sleeve valves 10 disclosed herein (see FIG. 10) or they may be the single sliding sleeve embodiment (see FIGS. 1-3).

Figure 20:
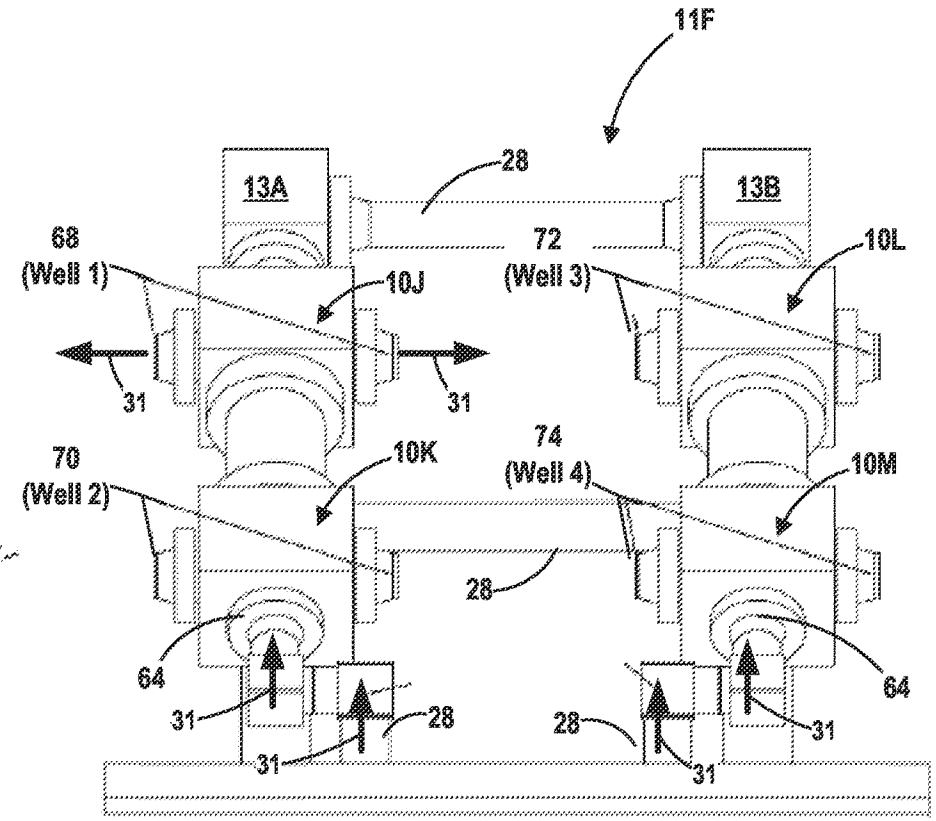
Figure 19:
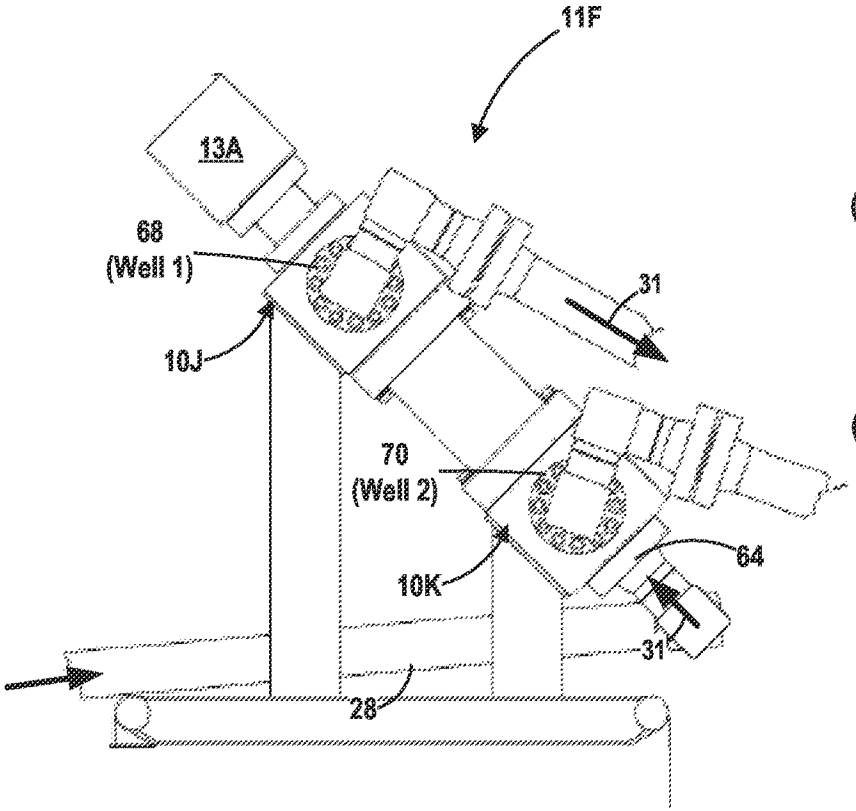
Figure 21:
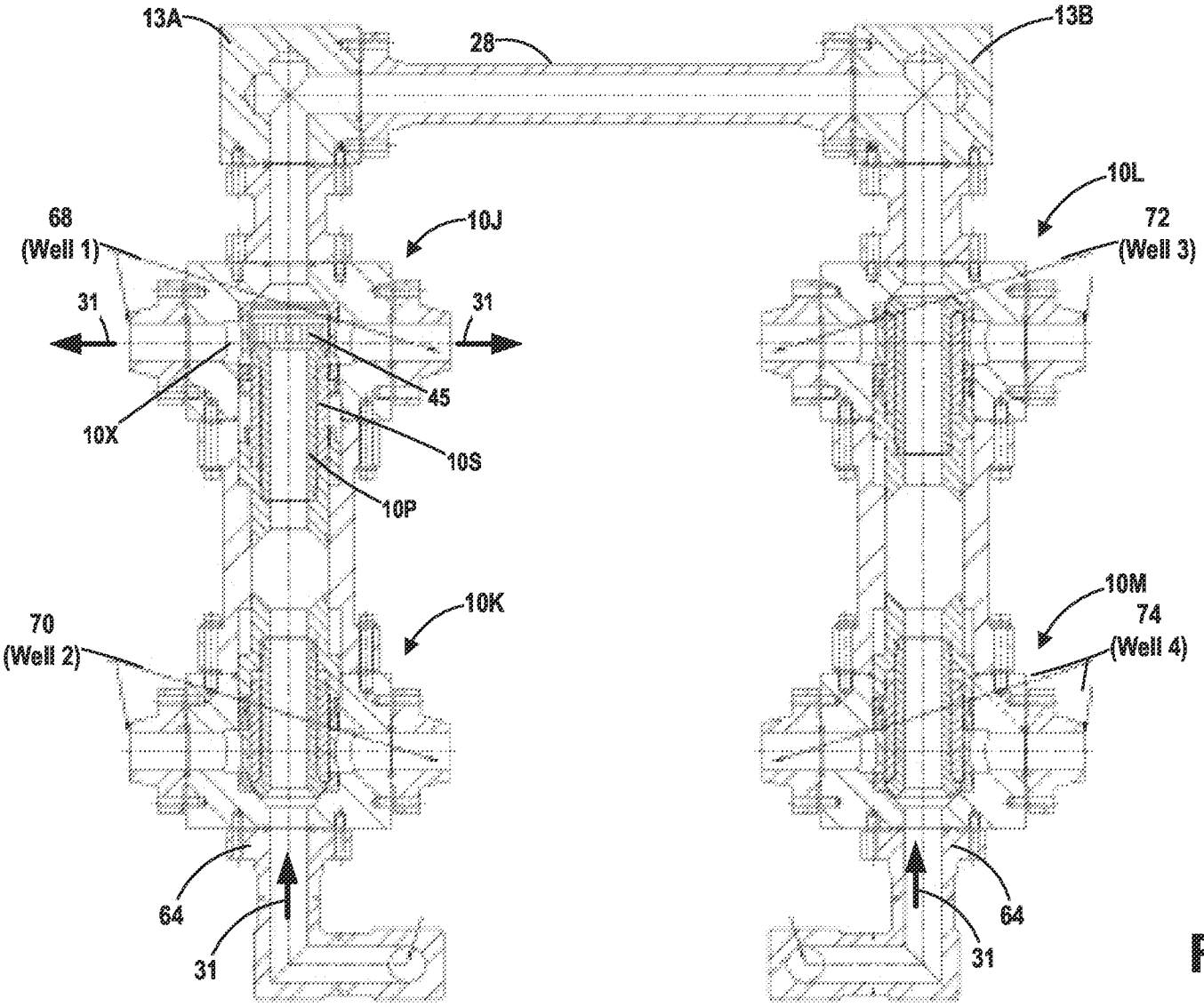

FIGS. 19-21 depict yet another illustrative system 11F for use in fracturing oil and gas wells that includes four of the above-described illustrative sliding sleeve valves 10J-10M. However, in the system 11F, the valves 10J-10M, respectively, comprise two dedicated outlets 68, 70, 72 and 74, respectively, for suppling fracturing fluid 31 to one of the four illustrative wells. Additionally, in the system 11F, there are two inlets 64 for the fracturing fluid 31 that is to be introduced into the second flow bore 22 of the valves 10. In the example depicted in FIGS. 19-21, the valve 10J will be opened so as to allow fracturing fluid 31 to flow into well number 1 while the valves 10K-M will be closed so as to prevent fracturing fluid 31 from entering the wells 2-4.

FIG. 21 is a cross-sectional view of the valves 10, which all have the same configuration. The valves 10 shown in FIGS. 19-21 are the dual sliding sleeve embodiment of the sliding sleeve valves 10 disclosed herein. However, if desired, the valves 10 included in the system 11F could be the single sliding sleeve embodiment (see FIGS. 1-3). The outlets 68, 70, 72 and 74 are in fluid communication with their respective fluid flow gallery 10X. In this embodiment, the valves 10 include the above-described optional wear sleeve 10B. Valve 10J is in its open position while the valves 10K-M are all in the closed position. With the valve 10J open, the fracturing fluid 31 entering the second flow bore 22 of the valve 10J flows through the openings 45 in the wear sleeve 10B, and out of the first flow bore 20 via the dedicated fluid outlets 68 to well 1, while the flow of fracturing fluid 31 to the other wells 2-4 is blocked. This process may be modified by opening and closing certain of the valves 10J-10M so as to direct the flow of fracturing fluid to one or more of the wells 1-4.

As will be appreciated by those skilled in the art after a complete reading of the present application, there are several novel inventions disclosed herein. In one illustrative example, a valve disclosed herein comprises a body 10R, a first flow bore 20 in the body 10R, wherein the first flow bore 20 comprises a fluid flow gallery 10X, a first fluid flow port 12 and a second fluid flow port 14 and wherein the fluid flow gallery 10X is in fluid communication with the first and second fluid flow ports 12, 14. In this example, the valve also comprises a second flow bore 22 in the body 10R and at least one sliding sleeve positioned in the body 10R, wherein the at least one sliding sleeve is adapted to be moved from a first closed position to a second open position, and vice-versa, wherein, in the first closed position, fluid communication between the first flow bore 20 and the second flow bore 22 is blocked and wherein, in the second open position, fluid communication between the first flow bore 20 and the second flow bore 22 is established. In further embodiments when the at least one sleeve is in the first closed position, the first flow bore 20 may be open to fluid flow through the first flow bore 20. In additional embodiments, when the at least one sleeve is in the first closed position, the second flow bore 22 may be open to fluid flow through the second flow bore 22. In other embodiments, the fluid flow gallery 10X may have a substantially annular configuration and it is positioned around the second flow bore 22.

One novel production tree 25 disclosed herein comprises a flow cross block 26, a first flow bore 20 in the flow cross block 26, wherein the first flow bore 20 comprises a fluid flow gallery 10X, a first fluid flow port 12 and a second fluid flow port 14 and wherein the fluid flow gallery 10X is in fluid communication with the first and second fluid flow ports. In this illustrative example, the production tree 25 further comprises a second flow bore 22 in the flow cross block 26 and at least one sliding sleeve positioned in the flow cross block 26, wherein the at least one sliding sleeve is adapted to be moved from a first closed position to a second open position, and vice-versa, wherein, in the first closed position, fluid communication between the first flow bore 20 and the second flow bore 22 is blocked and wherein, in the second open position, fluid communication between the first flow bore 20 and the second flow bore 22 is established. In further embodiments when the at least one sleeve is in the first closed position, the first flow bore 20 may be open to fluid flow through the first flow bore 20. In additional embodiments, when the at least one sleeve is in the first closed position, the second flow bore 22 may be open to fluid flow through the second flow bore 22. In other embodiments, the fluid flow gallery 10X may have a substantially annular configuration and it is positioned around the second flow bore 22.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown. It is therefore evident that the particular embodiments disclosed above may be altered or modified and all such variations are considered within the scope and spirit of the invention. Accordingly, the protection sought herein is as set forth in the claims below.

What is claimed:

1. A valve, comprising:

a body, wherein a lower flanged connection is provided on the body to couple the valve to a tree;

a first flow bore in the body, the first flow bore comprising a fluid flow gallery, a first fluid flow port and a second fluid flow port, wherein the fluid flow gallery is in fluid communication with the first and second fluid flow ports;

a second flow bore in the body;

at least one sliding sleeve positioned in the body, wherein the at least one sliding sleeve is adapted to be moved from a first closed position to a second open position, and vice-versa, wherein, in the first closed position, fluid communication between the first flow bore and the second flow bore is blocked and wherein, in the second open position, fluid communication between the first flow bore and the second flow bore is established.

2. The valve of claim 1, wherein, when the at least one sleeve is in the first closed position, the first flow bore is open to fluid flow through the first flow bore.

3. The valve of claim 2, wherein, when the at least one sleeve is in the first closed position, the second flow bore is open to fluid flow through the second flow bore.

4. The valve of claim 1, wherein the fluid flow gallery has a substantially annular configuration and is positioned around the second flow bore.

5. The valve of claim 1, wherein the at least one sliding sleeve is adapted to be moved from the first closed position to the second open position, and vice-versa, by application of hydraulic pressure outside of the first flow bore and the second flow bore.

6. The valve of claim 1, wherein the at least one sliding sleeve comprises two sliding sleeves, wherein the two sliding sleeves, when considered collectively, are adapted to be moved from the first closed position to the second open position, and vice-versa.

7. The valve of claim 1, wherein the at least one sliding sleeve comprises a first sliding sleeve and a second sliding sleeve, wherein the second sliding sleeve is positioned between the first sliding sleeve and the fluid flow gallery, wherein the first sliding sleeve and the second sliding sleeve, when considered collectively, are adapted to be moved from the first closed position to the second open position, and vice-versa.

8. The valve of claim 1, further comprising a perforated member positioned between the at least one sliding sleeve and the fluid flow gallery, wherein the at least one perforated member comprises at least one opening that extends through the perforated member.

9. The valve of claim 8, wherein the at least one opening in the perforated member comprises a plurality of openings.

10. The valve of claim 9, wherein the perforated member comprises a stationary wear sleeve, wherein the plurality of openings extend through the wear sleeve in first and second arcuate regions of the wear sleeve, wherein the wear sleeve comprises third and fourth arcuate regions that are free of any of the plurality of openings, and wherein the third and fourth arcuate regions are positioned between the first and second arcuate regions.

11. The valve of claim 1, further comprising a block that is coupled to the body of the valve, wherein the block comprises a fluid outlet that is in fluid communication with the second flow bore within the body, whereby fluid within the second flow bore may exit the valve via the fluid outlet in the block.

* * * * *